US010303095B2

(12) United States Patent
Takagi et al.

(10) Patent No.: US 10,303,095 B2
(45) Date of Patent: May 28, 2019

(54) IMAGE FORMING APPARATUS THAT ACQUIRES A TEMPERATURE OF A HEATER IN A REGION IN WHICH A HEAT GENERATION MEMBER IS FORMED BASED ON A DETECTED RESISTANCE OF THE HEAT GENERATION MEMBER

(71) Applicant: CANON KABUSHIKI KAISHA, Tokyo (JP)

(72) Inventors: Kenji Takagi, Odawara (JP); Masamitsu Watahiki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/759,678

(22) PCT Filed: Sep. 6, 2016

(86) PCT No.: PCT/JP2016/076729
§ 371 (c)(1),
(2) Date: Mar. 13, 2018

(87) PCT Pub. No.: WO2017/047531
PCT Pub. Date: Mar. 23, 2017

(65) Prior Publication Data

US 2019/0041779 A1 Feb. 7, 2019

(30) Foreign Application Priority Data

Sep. 14, 2015 (JP) ..... 2015-181139

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/2039; G03G 15/2053; G03G 15/2064; G03G 2215/772; G03G 2215/949
(Continued)

(56) References Cited

U.S. PATENT DOCUMENTS 5,402,211 A 3/1995 Yoshikawa
6,091,059 A * 7/2000 Sato ..... G03G 15/2053 219/216
(Continued)

FOREIGN PATENT DOCUMENTS

JP H04326387 A 11/1992
JP H06186877 A 7/1994
(Continued)

OTHER PUBLICATIONS

International Search Report and Written Opinion dated Apr. 10, 2018, issued in corresponding International Application No. PCT/JP2016/076729.
(Continued)

*Primary Examiner* — Hoan H Tran
(74) *Attorney, Agent, or Firm* — Venable LLP

(57) ABSTRACT

An image forming apparatus includes a fixing unit having a heater, an energization control unit configured to control energization to a first heat generation member of the heater depending on a temperature detected by a temperature detection element of the fixing unit, a resistance detecting unit configured to detect a resistance of a second heat generation member of the heater, and a temperature acquiring unit configured to acquire a temperature of the heater in the region in which the second heat generation member is formed based on the resistance detected by the resistance detecting unit. An image, formed on a recording material, is fixed to the recording material with heat form the heater.

14 Claims, 18 Drawing Sheets

(58) Field of Classification Search
USPC ..... 399/38, 67–69, 107, 110, 122, 320, 399/328–330; 219/216, 619
See application file for complete search history.

(56) References Cited

U.S. PATENT DOCUMENTS

| | | | | |
|---|---|---|---|---|
| 7,599,637 | B2 | 10/2009 | Nanataki et al. | |
| 7,865,102 | B2 | 1/2011 | Nanataki et al. | |
| 8,229,338 | B2 | 7/2012 | Nanataki et al. | |
| 9,235,166 | B2 | 1/2016 | Shimura | |
| 9,298,141 | B2 * | 3/2016 | Itoh | G03G 15/2039 |
| 9,436,139 | B2 * | 9/2016 | Kadowaki | G03G 15/2039 |
| 9,501,005 | B2 * | 11/2016 | Okamoto | G03G 15/2042 |
| 9,545,456 | B2 * | 1/2017 | Oraevsky | A61K 49/223 |
| 2007/0012676 | A1 | 1/2007 | Koide et al. | |
| 2012/0076521 | A1 | 3/2012 | Ishihara et al. | |
| 2012/0155937 | A1 | 6/2012 | Hamilton et al. | |
| 2013/0034362 | A1 * | 2/2013 | Matsuura | G03G 15/2042 399/69 |
| 2014/0076878 | A1 | 3/2014 | Shimura | |
| 2014/0105658 | A1 * | 4/2014 | Tamaki | G03G 15/2032 399/329 |
| 2016/0070216 | A1 | 3/2016 | Shimura | |

FOREIGN PATENT DOCUMENTS

| | | | |
|---|---|---|---|
| JP | 2009282335 | A | 12/2009 |
| JP | 201459508 | A | 4/2014 |
| JP | 2014145895 | A | 8/2014 |
| JP | 2014228731 | A | 12/2014 |
| WO | 2015/141217 | A1 | 9/2015 |

OTHER PUBLICATIONS

International Search Report and Written Opinion dated Sep. 6, 2016, issued in corresponding International Application No. PCT/JP2016/076729.

* cited by examiner

IMAGE FORMING APPARATUS THAT ACQUIRES A TEMPERATURE OF A HEATER IN A REGION IN WHICH A HEAT GENERATION MEMBER IS FORMED BASED ON A DETECTED RESISTANCE OF THE HEAT GENERATION MEMBER

This application claims the benefit of Japanese Patent Application No. 2015-181139, filed Sep. 14, 2015, which is hereby incorporated by reference herein in its entirety.

BACKGROUND OF THE INVENTION

Technical Field

The present invention relates to an image forming apparatus employing an electrophotographic system.

Background Art

A fixing device configured to heat and fix a toner image, formed on a recording material, to the recording material is mounted on an image forming apparatus, e.g., an electrophotographic copying machine or an electrophotographic printer.

Incidentally, when an image forming apparatus continuously performs printing on small-sized sheets, a phenomenon that a temperature in a region of the fixing device through which the recording materials do not pass gradually rises (non-sheet-feeding portion temperature rise) occurs. When the temperature of the non-sheet-feeding portion becomes too high, parts in the apparatus may be damaged, and thus, measures are required to be taken against a too high temperature of the non-sheet-feeding portion.

In Japanese Patent Application Laid-Open No. 2014-059508, there is described the structure in which a heat generation area of a heater is divided into a plurality of areas in a heater longitudinal direction, so that energization of each heat generation area (heat generation block) is independently controllable. With this structure, a temperature rise in the non-sheet-feeding portion is suppressed.

Technical Problem

Incidentally, recording materials used in the apparatus are of variety of sizes, and thus, even if control is exerted so that a heat generation area unnecessary for fixing processing may not generate heat, there is a case in which a heat generation distribution of the heater does not conform to the size of the recording material passing therethrough. When the heat generation distribution of the heater and the size of the recording material do not conform to each other, there is, among a plurality of the heat generation areas, a heat generation area having both a region through which the recording material passes and a region through which the recording material does not pass. The non-sheet-feeding portion temperature rise occurs in the heat generation area having both the region through which the recording material passes and the region through which the recording material does not pass. In short, even when the structure in which the heat generation area of the heater is divided into a plurality of areas in the heater longitudinal direction is adopted, it is difficult to completely suppress the non-sheet-feeding portion temperature rise. Therefore, measures are required to be taken, for example, monitoring the temperatures of the respective heat generation areas, and then stopping the printing operation when the temperatures reach an abnormal temperature. In order to monitor the temperatures of the heat generation areas, the structure is conceivable in which a temperature detection element is arranged in each heat generation area.

As the number of the heat generation areas increases, however, the number of the temperature detection elements increases as well, and it becomes more difficult to arrange the temperature detection element in each heat generation area.

SUMMARY OF THE INVENTION

It is an object of the present invention to provide an image forming apparatus that can monitor temperatures in respective heat generation areas without arranging a temperature detection element in each heat generation area.

In one aspect, the present invention provides an image forming apparatus including a fixing unit configured to fix an image, formed on a recording material, to the recording material, the fixing unit including a heater including a first heat generation member, and a second heat generation member controllable independently of the first heat generation member and formed in a region different from a region in which the first heat generation member is formed in a direction orthogonal to a recording material conveyance direction, and a temperature detection element configured to detect a temperature of the region in which the first heat generation member is formed of the heater, and an energization control unit configured to control energization to the first heat generation member depending on the temperature detected by the temperature detection element, in which the image formed on the recording material is fixed to the recording material with heat from the heater, and in which the image forming apparatus further includes a resistance detecting unit configured to detect a resistance of the second heat generation member, and a temperature acquiring unit configured to acquire a temperature of the heater in the region in which the second heat generation member is formed based on the resistance detected by the resistance detecting unit.

Further features of the present invention will become apparent from the following description of exemplary embodiments with reference to the attached drawings.

DESCRIPTION OF EMBODIMENTS

Now, with reference to the attached drawings, modes for carrying out the present invention are illustratively described in detail based on embodiments. Dimensions, materials, shapes, relative arrangements, and the like, of components described in the embodiments should, however, be changed as appropriate depending on the structure and various kinds of conditions of an apparatus to which the present invention is applied. In other words, it is not intended to limit the scope of the present invention to the embodiments described below.

First Embodiment

Image Forming Apparatus (Printer)

Figure 1:
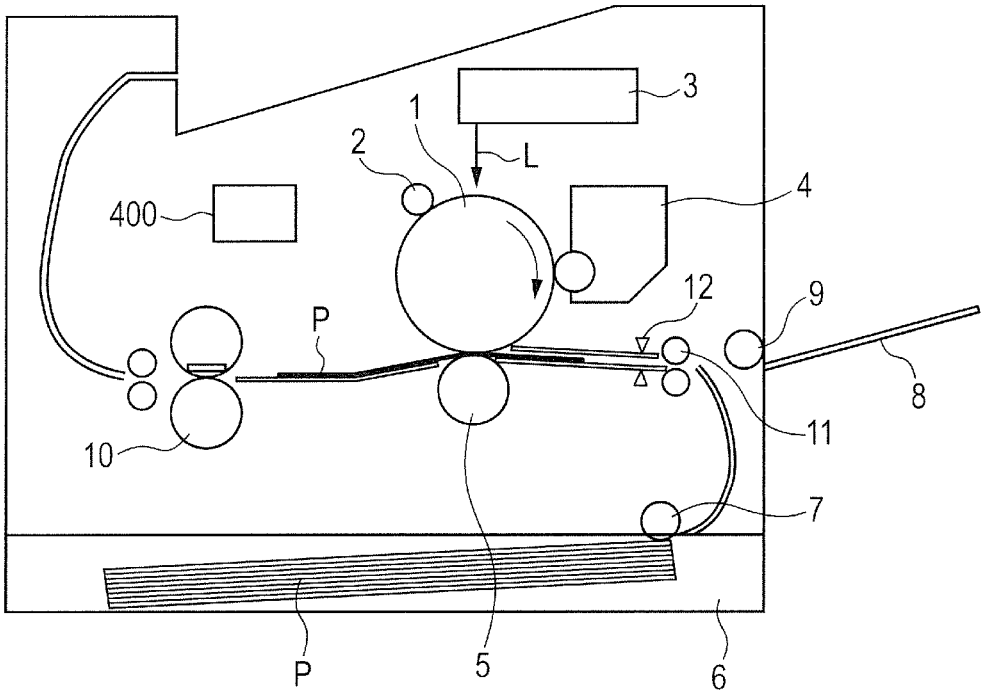
FIG. 1 is a sectional view of an image forming apparatus according to a first embodiment of the present invention.

FIG. 1 is a schematic sectional view for illustrating the schematic structure of a laser beam printer (hereafter referred to as printer) as an image forming apparatus according to an embodiment of the present invention. The image forming apparatus includes a photosensitive drum 1 that rotates about an axis thereof. The photosensitive drum 1 is driven to rotate in a direction shown by the arrow, and a surface thereof is uniformly charged by a charging roller 2 as a charging device. Then, a laser scanner 3 performs scanning and exposure with a laser beam L that is controlled between an on state and an off state in accordance with image information, and an electrostatic latent image is formed. A developing device 4 attaches toner to the electrostatic latent image to develop a toner image (developer image) on the photosensitive drum 1. After that, the toner image formed on the photosensitive drum 1 is transferred, at a transfer nip portion at which the transfer roller 5 and the photosensitive drum 1 are in pressure contact with each other, onto a recording material P as a material to be heated that is conveyed from a sheet feed cassette 6 by a sheet feed roller 7 at a predetermined timing. At this time, a leading edge of the recording material conveyed by a conveyance roller 11 is detected by a top sensor 12 so that an image formation position of the toner image on the photosensitive drum 1 and a writing start position of the leading edge of the recording material P may be spatially coincident with each other, and the timing is adjusted. The recording material P conveyed to the transfer nip portion at a predetermined timing is sandwiched and conveyed between the photosensitive drum 1 and the transfer roller 5 with fixed pressurization. In this embodiment, in the structure of the image forming apparatus, the structure relating to a step of forming a toner image on the recording material is referred to as an image forming unit. The recording material P, onto which the toner image is transferred, is conveyed to the fixing device 10 (fixing unit), and the toner image is heated and fixed to the recording material P in the fixing device 10. After that, the recording material P is delivered onto a delivery tray.

The printer of this embodiment accommodates a plurality of recording material sizes. In the sheet feed cassette 6, letter size sheets (about 216 mm×279 mm), legal size sheets (about 216 mm×356 mm), A4 sheets (210 mm×297 mm), and executive size sheets (about 184 mm×267 mm) can be set. Further, B5 sheets (182 mm×257 mm) and A5 sheets (148 mm×210 mm) can be set.

Further, nonstandard-sized sheets including a DL envelope (110 mm×220 mm) and a COM 10 envelope (about 105 mm×241 mm) can be fed from a sheet feed tray 8 by an MP sheet feed roller 9, and printing can be performed thereon. The printer of this embodiment is a laser printer that basically feeds a sheet vertically (conveys a sheet so that a longitudinal side thereof may be in parallel with a conveyance direction). Recording materials having the largest (widest) width of standard-sized recording material widths that the apparatus accommodates (recording material widths in a catalog) are a letter size sheet and a legal size sheet, and the widths thereof are about 216 mm. A recording material P having a sheet width that is less than the maximum size that the apparatus accommodates is defined as a small-sized sheet in this embodiment.

Fixing Device

Figure 2:
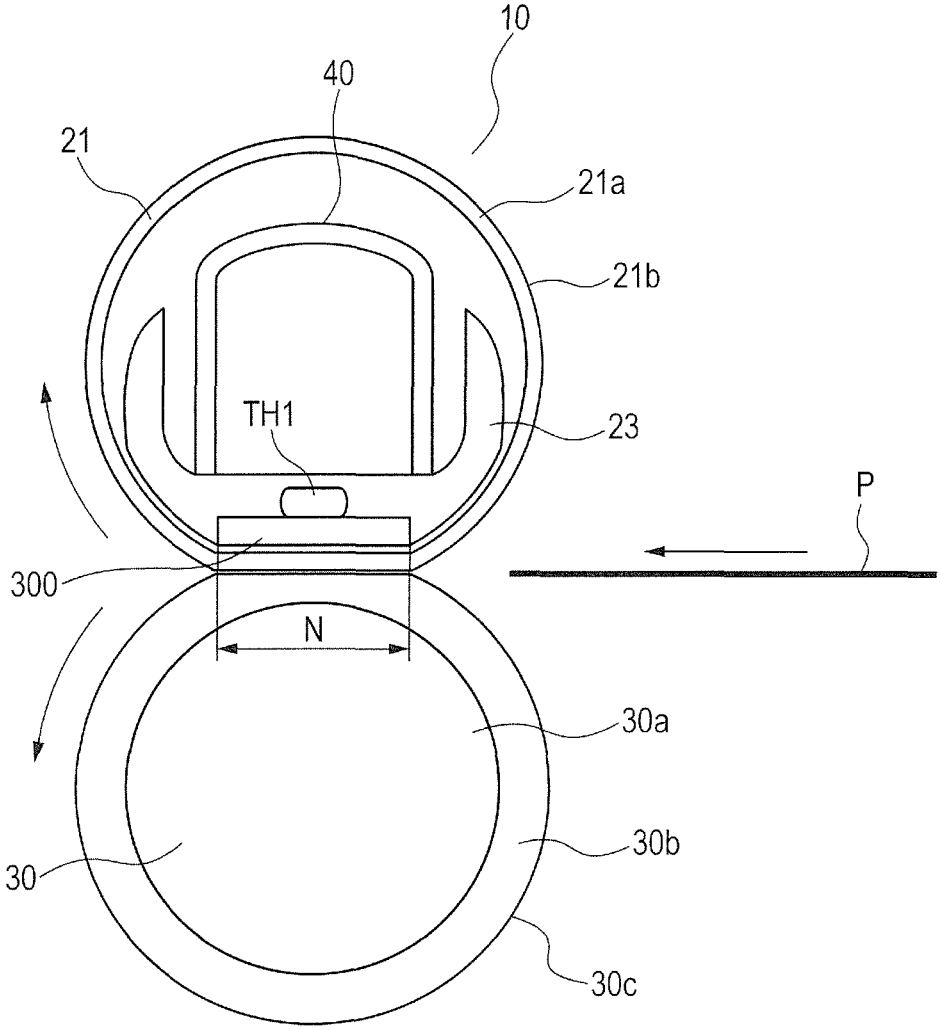
FIG. 2 is a sectional view of a fixing device according to the first embodiment.

With reference to FIG. 2, the fixing device 10 according to this embodiment is described. FIG. 2 is a sectional view of the fixing device 10. The fixing device 10 includes a tubular film 21 (endless film), a heater 300 in contact with an inner surface of the film 21, and a pressure roller 30 that forms, together with the heater 300, a fixing nip portion N via the film 21.

The film 21 includes a base layer 21*a* and a release layer 21*b* formed outside the base layer. The base layer 21*a* is formed of a heat-resistant resin, e.g., a polyimide, a polyamide-imide, or polyetheretherketone (PEEK), or of a metal, e.g., steel use stainless (SUS). In this embodiment, a polyimide having a thickness of 65 μm is used. The release layer 21*b* is formed by coating the base layer 21*a* with a heat-resistant resin having a satisfactory releasing property, for example, a fluorine resin, e.g., polytetrafluoroethylene (PTFE), tetrafluoroethylene-perfluoroalkyl vinylether copolymer (PFA), or tetrafluoroethylene-hexafluoropropylene copolymer (FEP), a silicone resin, or the like, solely or in combination. In this embodiment, PFA having a thickness of 15 μm is used for coating. The film 21 of this embodiment has a length in a longitudinal direction of 240 mm and an outer diameter of 24 mm.

A film guide 23 is a guide member used when the film 21 is rotated, and the film 21 is loosely fitted on the film guide 23. Further, the film guide 23 also acts as a heater support configured to support the heater 300. The film guide 23 is formed of a heat-resistant resin, e.g., a liquid crystal polymer, a phenol resin, polyphenylene sulfide (PPS), or PEEK.

The pressure roller 30 as a pressurizing member includes a metal core 30*a* and an elastic layer 30*b* formed outside the metal core. The metal core 30*a* is formed of a metal, e.g., SUS, steel use machinery (SUM), or aluminum (Al). The elastic layer 30*b* is formed of heat-resistant rubber, e.g., silicone rubber or fluorine rubber, or foamed silicone rubber. The pressure roller 30 has a release layer 30*c* outside the elastic layer 30*b*, and PFA as a fluorine resin was formed at a thickness of 50 μm. The pressure roller 30 of this embodiment has an outer diameter of 25 mm, and the elastic layer 30*b* is formed of silicone rubber at a thickness of 3.5 mm. Further, in the pressure roller 30, the elastic layer 30*b* has a length in a longitudinal direction of 230 mm.

A stay 40 is a member for applying, to the film guide 23, pressure in a direction toward the pressure roller 30 with a spring (not shown) to form, between the film 21 and the pressure roller 30, the fixing nip unit N configured to heat and to fix toner on the recording material P, and a highly stiff metal is used therefor.

The pressure roller 30 is rotated by driving force transmitted from a driving source (not shown) to a gear (not shown) arranged at an end portion of the metal core 30*a* in the longitudinal direction. The film 21 is rotated following the pressure roller 30 by friction force applied thereto at the fixing nip unit N by the rotating pressure roller 30.

A thermistor TH1 as a temperature detection element (temperature detecting unit) of the heater 300 is held in contact with a back surface side (surface on a side opposite to a surface held in contact with the film 21) of the heater 300.

Heater

Figure 3A:
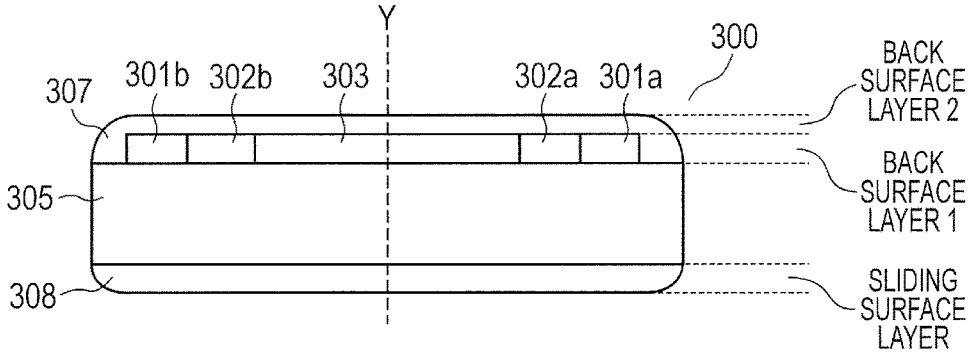
FIG. 3A is a structural view of a heater according to the first embodiment and is a sectional view taken along line 3A-3A of FIG. 3B.
Figure 3B:
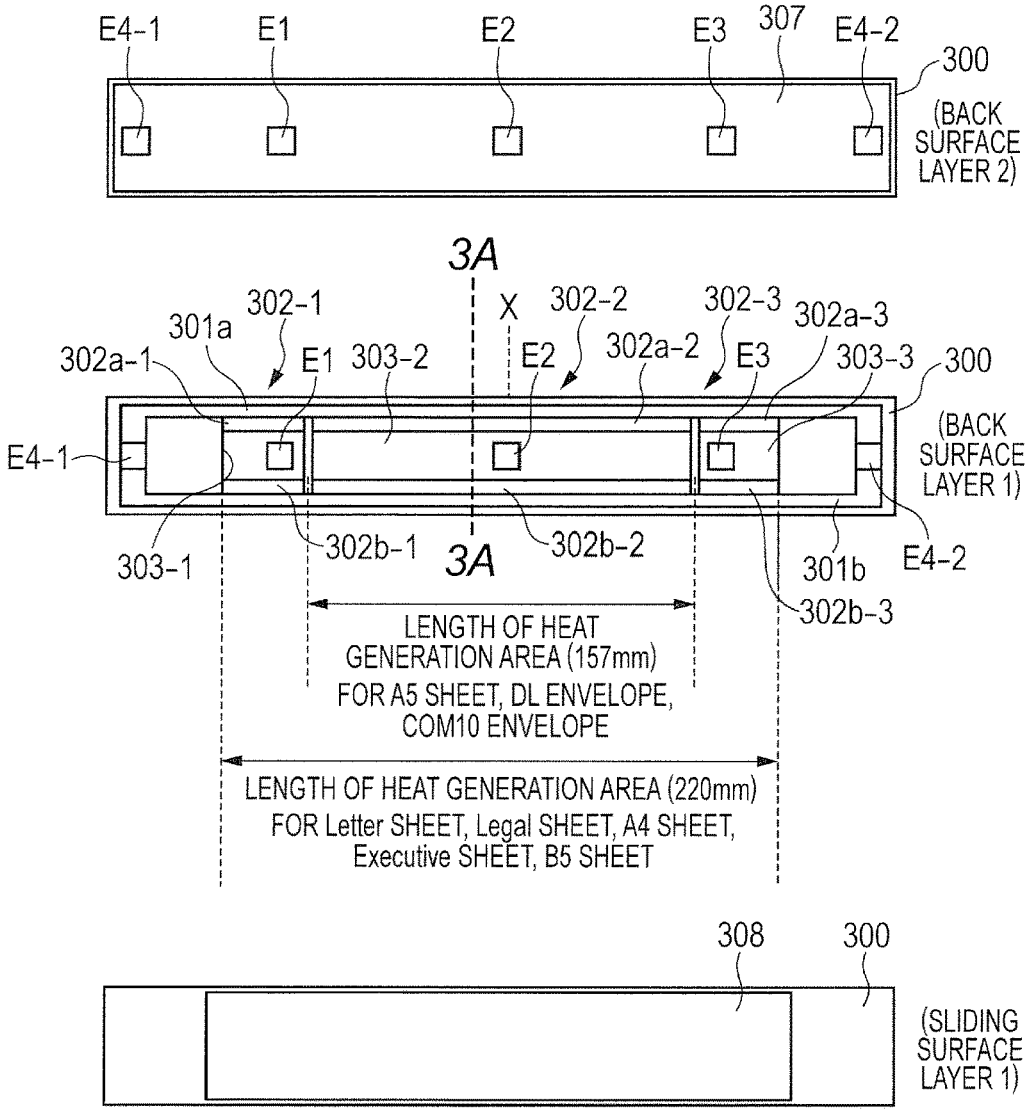
FIG. 3B includes plan view of layers of a heater according to the first embodiment.

FIG. 3A and FIG. 3B are structural views of the heater 300 according to the first embodiment. FIG. 3A is a sectional view of the heater 300 taken along its lateral direction (direction in parallel with the recording material conveyance direction) (3A-3A cross section of FIG. 3B). First conductors 301 (301*a* and 301*b*) are formed on a substrate 305 in a back surface layer 1 of the heater 300 along a longitudinal direction of the heater 300 (direction orthogonal to the recording material conveyance direction). Further, second conductors 303 (303-1, 303-2, and 303-3) are formed on the substrate 305 at locations different from those of the first conductors 301 in the lateral direction of the heater 300 along the longitudinal direction of the heater 300. The first conductors 301 are split into a conductor 301*a* on an upstream side and a conductor 301*b* on a downstream side in the conveyance direction of the recording material P.

Heat generating resistors (heat generation members) 302 (302*a* and 302*b*) are formed between the first conductors 301 and the second conductors 303, and are configured to generate heat using electrical power supplied via the first conductors 301 and the second conductors 303. The heat generating resistors 302 are split into heat generating resistors 302*a* (302*a*-1, 302*a*-2, and 302*a*-3) on the upstream side and heat generating resistors 302*b* (302*b*-1, 302*b*-2, and 302*b*-3) on a downstream side in the conveyance direction of the recording material P.

When a heat generation distribution in the lateral direction of the heater 300 is asymmetrical, stress produced in the substrate 305 when the heater 300 generates heat becomes greater. When the stress produced in the substrate 305 becomes greater, a crack may develop in the substrate 305. Therefore, the heat generating resistors 302 are split into the heat generating resistors 302*a* on the upstream side and the heat generating resistors 302*b* on the downstream side in the conveyance direction so that the heat generation distribution in the lateral direction of the heater 300 may be symmetrical with respect to a center Y in the lateral direction.

An insulating surface protective layer 307 (in this embodiment, glass), covering the heat generating resistors 302, the conductors 301, and the conductors 303, is formed in a back surface layer 2 of the heater 300. Further, a surface protective layer 308, formed of sliding glass or polyimide coating, is formed in a layer 1 as a sliding surface (surface that is brought into contact with the film 21) of the heater 300.

FIG. 3B includes plan views of the respective layers of the heater 300. The heater 300 has a plurality of heat generation blocks each including a set of first conductors 301, a second conductor 303, and heat generating resistors 302 on the back surface layer 1 in the longitudinal direction of the heater 300. As an example, the heater 300 of this embodiment includes three heat generation blocks in total in a center portion and both end portions of the heater 300 in the longitudinal direction of the heater 300. A heat generation block 302-1 includes the heat generating resistors (second heat generation members) 302*a*-1 and 302*b*-1 formed so as to be symmetrical in the lateral direction of the heater 300. Similarly, a heat generation block 302-2 includes the heat generating resistors (first heat generation members) 302*a*-2 and 302*b*-2, and a heat generation block 302-3 includes the heat generating resistors (second heat generation members) 302*a*-3 and 302*b*-3. The second heat generation members are controlled independently of the first heat generation members.

The first conductors 301 are formed along the longitudinal direction of the heater 300. The first conductors 301 include the conductor 301*a* connected to the heat generating resistors (302*a*-1, 302*a*-2, and 302*a*-3) and the conductor 301*b* connected to the heat generating resistors (302*b*-1, 302*b*-2, and 302*b*-3). The second conductors 303 formed along the longitudinal direction of the heater 300 are split into three, i.e., the conductors 303-1, 303-2, and 303-3. As a material of the first conductors 301 and the second conductors 303, silver (Ag) is used. As a material of the heat generating resistors 302, a heat generating resistor containing ingredients, such as a conductive agent mainly formed of ruthenium oxide ($RuO_2$) and glass and having positive temperature coefficient (PTC) characteristics was used.

Electrodes E1, E2, E3, E4-1, and E4-2 are connected to electrical contacts for supplying electrical power from an alternating current (AC) power supply . The electrode E1 is an electrode for energizing the heat generation block 302-1 (302*a*-1 and 302*b*-1) via the conductor 303-1. Similarly, the electrode E2 is an electrode used for energizing the heat generation block 302-2 (302*a*-2 and 302*b*-2) via the conductor 303-2. The electrode E3 is an electrode for energizing the heat generation block 302-3 (302*a*-3 and 302*b*-3) via the conductor 303-3. The electrodes E4-1 and E4-2 are common electrodes for energizing the three heat generation blocks 302-1 to 302-3 via the conductor 301*a* and the conductor 301*b*.

Incidentally, a conductor has a resistance that is not zero, and thus, a resistance of a conductor affects the heat generation distribution in the longitudinal direction of the heater 300. Therefore, for the purpose of obtaining a uniform heat generation distribution in the longitudinal direction of the heater 300 under the influence of electrical resistances of the conductors 303-1, 303-2, 303-3, 301*a*, and 301*b*, the electrodes E4-1 and E4-2 are formed at both ends of the heater 300 in the longitudinal direction.

Further, the surface protective layer 307 in the back surface layer 2 of the heater 300 is formed except at locations of the electrodes E1, E2, E3, E4-1, and E4-2, and the electrical contacts can be connected to the respective electrodes from the back surface side of the heater 300. In this embodiment, the electrodes E1, E2, E3, E4-1, and E4-2 are formed on the back surface of the heater 300 so that electrical power can be supplied from the back surface side of the heater 300. Further, a ratio between electrical power supplied to at least one heat generation block among the plurality of heat generation blocks and electrical power supplied to other heat generation blocks is variable as described below. The electrodes E1, E2, and E3 are formed in a region in a longitudinal direction of the substrate in which the heat generating resistors are formed. Further, the surface protective layer 308 in the sliding surface layer 1 of the heater 300 is formed in a region that slides with respect to the film 21.

A hole (not shown) for electrical contacts of the thermistor (temperature detection element) TH1 and the electrodes E1, E2, E3, E4-1, and E4-2 is formed in the film guide 23. The electrodes E1, E2, E3, E4-1, and E4-2 are connected to the AC power supply via a conductive material, e.g., a cable or a thin metal plate. The thermistor (temperature detection element) TH1 is connected to a control circuit 400 to be described below.

The thermistor TH1 was arranged at a place that was 30 mm away from a conveyance reference X of the recording material P to the electrode E4-1 side in the substrate longitudinal direction (at the same location as 3A-3A) and at a center location in a substrate lateral direction.

Figure 4:
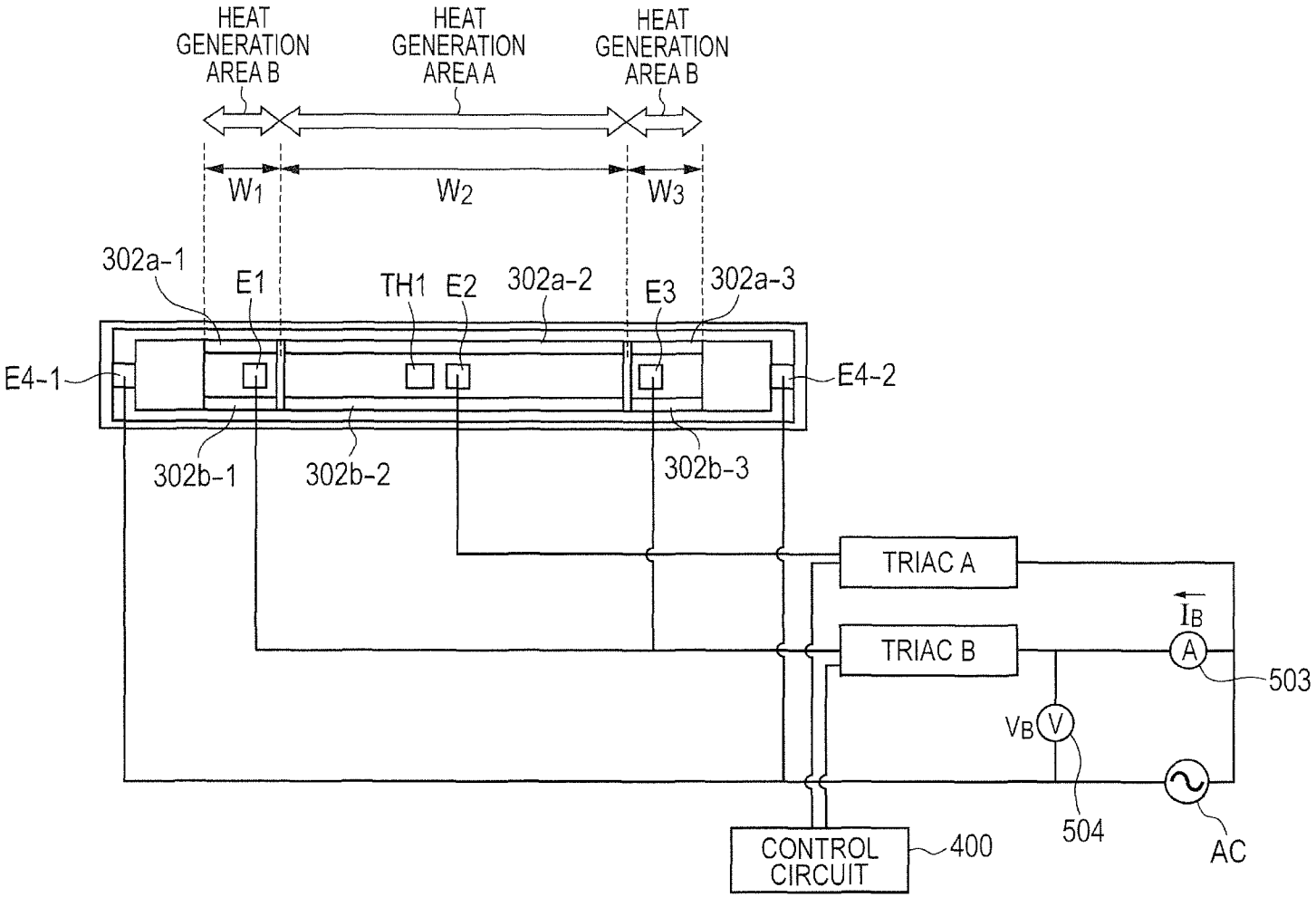
FIG. 4 is an electrical power control circuit diagram according to the first embodiment.

With reference to FIG. 4, control of electrical power to the heater 300 is described. FIG. 4 is an electrical power control circuit diagram. During the fixing processing, the control circuit 400 as an energization control unit controls a triac A and a triac B so that a temperature detected by the thermistor TH1 may be maintained at a predetermined control target temperature. A ratio between electrical power supplied to the heat generation block 302-2 (duty ratio of a time during which the triac A is ON) and electrical power supplied to the heat generation blocks 302-1 and 302-3 (duty ratio of a time during which the triac B is ON) is set in accordance with information on the size of the recording material P, or the like. In this embodiment, the control circuit 400 controls operation of the respective structures in the image forming apparatus (such as a rotating operation of the photosensitive drum 1 and of the sheet feed roller 7, and the like), and also functions as an operation control unit configured to carry out a failure avoiding operation to be described later. Through control of the triac A and the triac B, a heat generation area A as a heat generation area of the heat generation block 302-2 and heat generation areas B as heat generation areas of the heat generation blocks 302-1 and 302-3 formed on both sides thereof, respectively, can be independently controlled.

Further, a current detection circuit 503 configured to detect a current $I_B$ passing through the second heat generation members (302*a*-1, 302*b*-1, 302*a*-3, and 302*b*-3) and a voltage detection circuit 504 configured to detect a voltage $V_B$ applied to the second heat generation members are provided in the electrical power control circuit. These detection circuits are used to detect a resistance of the second heat generation members and the details are described later.

In this case, a longitudinal width $W_2$ of the heat generation block 302-2 longitudinally in the center that forms the heat generation area A is 157 mm. Further, a longitudinal width $W_1$ of the heat generation block 302-1 and a longitudinal width $W_3$ of the heat generation block 302-3 longitudinally at both ends that form the heat generation areas B are 31.5 mm and 31.5 mm, respectively. When the heat generation area A is mainly energized, the longitudinal width of the heat generation area A is 157 mm ($=W_2$), which is suitable for heating a sheet having a recording material width that is less than 157 mm. Specifically, in this embodiment, there can be provided examples, such as an A5 sheet, a DL envelope, a COM 10 envelope, and a nonstandard-sized sheet having a width that is less than 157 mm. Further, when both the heat generation area A and the heat generation areas B are energized, the sum of the longitudinal width of the heat generation area A and the longitudinal widths of the heat generation areas B is 220 mm ($=W_1+W_2+W_3$), which is suitable for heating a sheet having a recording material width that is less than 220 mm and greater than 157 mm. Specifically, in this embodiment, there can be provided examples, such as a letter size sheet, a legal size sheet, an A4 sheet, an executive size sheet, and a B5 sheet.

Figure 5A:
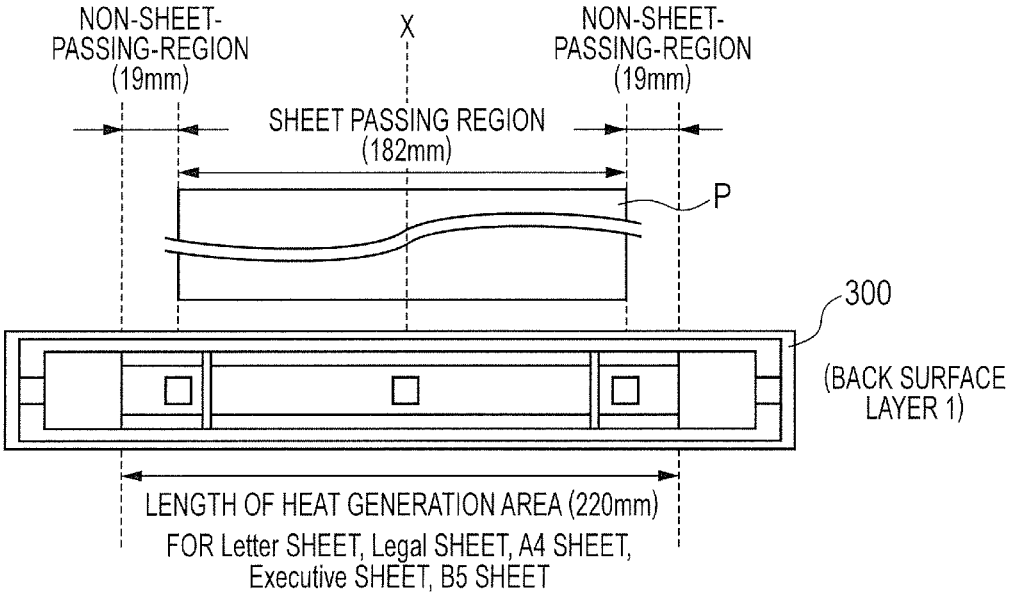
FIGS. 5A and 5B are schematic views for illustrating the relationship between a heated width and sheet widths illustrated in the first embodiment.
Figure 5B:
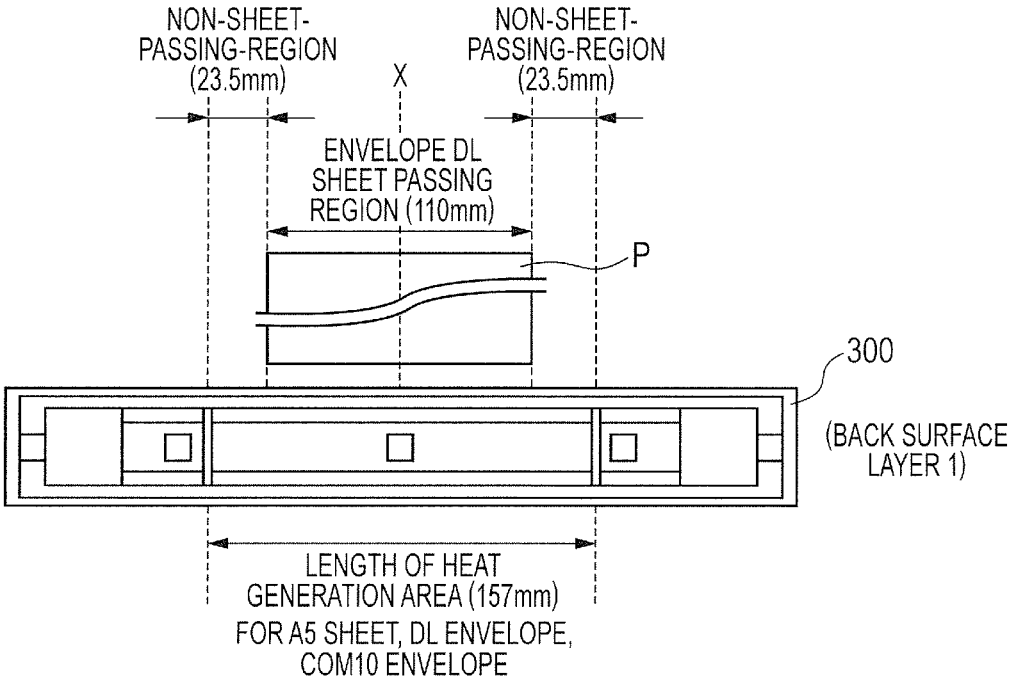

With reference to FIG. 5A and FIG. 5B, a method of switching the heat generation area of the heater 300 depending on the size of the recording material P is described. FIG. 5A is an explanatory view of a non-sheet-feeding portion temperature rise when electrical power is supplied to both the heat generation area A and the heat generation areas B. A case in which a B5 sheet is conveyed in a vertical direction with reference to a center portion of the heat generation area is illustrated as an example.

The sheet feed cassette 6 includes a location regulating plate configured to regulate the location of the recording material P, and feeds the recording material P from a predetermined location depending on the size of the loaded recording material P and conveys the recording material P so that the recording material P passes through a predetermined location of the fixing device 10. Similarly, the sheet feed tray 8 also includes a location regulating plate configured to regulate the location of the recording material P, and conveys the recording material P so that the recording material P passes through the predetermined location of the fixing device 10. The printer of this embodiment is a center-referenced image forming apparatus in which a recording material P is conveyed with a center of the recording material P in a width direction being aligned with the conveyance reference X that is set at the center in the heater longitudinal direction.

For a case in which a letter size sheet having a sheet width of about 216 mm is conveyed in the vertical direction, the heater 300 has a heat generation area length of 220 mm. When a B5 sheet having a sheet width of 182 mm is conveyed in the vertical direction through the heater 300 having a heat generation area length of 220 mm, a non-sheet-feeding region of 19 mm appears at each of both end portions of the heat generation area. Control of electrical power to the heater 300 is exerted so that the temperature detected by the thermistor TH1 provided in the vicinity of the center of the sheet-feeding unit may maintain the target temperature, but heat is not absorbed by the sheet in the non-sheet-feeding portions, and thus, the temperature of the non-sheet-feeding portions becomes greater than that of the sheet-feeding unit.

As illustrated in FIG. 5A, when the recording material P is a B5-sized sheet, end portions of the recording material P pass through part of regions of the heat generation areas B at both end portions of the heat generating region, respectively, and the non-sheet-feeding portion of 19 mm appears at each of the end portions of the heat generating region. Heat is not absorbed by the recording material P in regions of the heat generating resistors 302 that correspond to the non-sheet-feeding portions, and thus, the temperature thereof becomes relatively greater than that of a region corresponding to the sheet-feeding unit. The heat generating resistors 302 have the PTC characteristics, however, and thus, the portions of the heat generating resistors 302 corresponding to the non-sheet-feeding portions have a resistance that is greater than that of the portion corresponding to the sheet-feeding unit, and current is less liable to pass therethrough. Using this principle, temperature rise of the non-sheet-feeding portions can be suppressed to some extent.

FIG. 5B is an explanatory view of a non-sheet-feeding portion temperature rise when electrical power is supplied only to the heat generation area A in the center portion of the heater 300. Here, the heat generation areas B are also subtly energized to the extent of detecting the resistance of the heat generation areas B, but not to the extent of contributing to heat generation (about 5 msec per second). As an example, FIG. 5B is an illustration of a case in which a DL-sized envelope having a width of 110 mm is conveyed in the vertical direction with reference to the center portion of the heat generation area. For a case in which an A5 sheet having a sheet width of 148 mm is conveyed in the vertical direction, the heat generation area A of the heater 300 has a length of 157 mm. When a DL-sized envelope having a width of 110 mm is conveyed in the vertical direction through the heat generation area A having a length of 157 mm, a non-sheet-feeding region of 23.5 mm appears at each of both end portions of the heat generation area A. Control of the heater 300 is exerted based on output of the thermistor TH1 provided in the vicinity of the center of the sheet-feeding unit. Heat is not absorbed by the sheet in the non-sheet-feeding portions, and thus, the temperature of the non-sheet-feeding portions becomes greater than that at the sheet-feeding unit.

In the state illustrated in FIG. 5B, first, through supply of electrical power only to the heat generation area A, the influence of the non-sheet-feeding regions can be reduced. In general, as the non-sheet-feeding region becomes longer, the non-sheet-feeding portion temperature rise increases, and thus, there is a case in which only the effect of energizing the heat generating resistors 302 having the PTC characteristics in the conveyance direction cannot fully suppress the non-sheet-feeding portion temperature rise. In such a case, as illustrated in FIG. 5B, a method of reducing the length of the heat generation area as much as possible is effective. Further, in the non-sheet-feeding region of 23.5 mm at each of both end portions of the heat generation area A in the center, the temperature rise can be suppressed by a principle similar to that of the case illustrated in FIG. 5A.

In both the cases illustrated in FIG. 5A and FIG. 5B, however, the non-sheet-feeding portion temperature rise cannot be completely eliminated. A temperature rise of the non-sheet-feeding portions leads to failure of the apparatus. Therefore, it is necessary to detect the temperature of the non-sheet-feeding portions.

Figure 6:
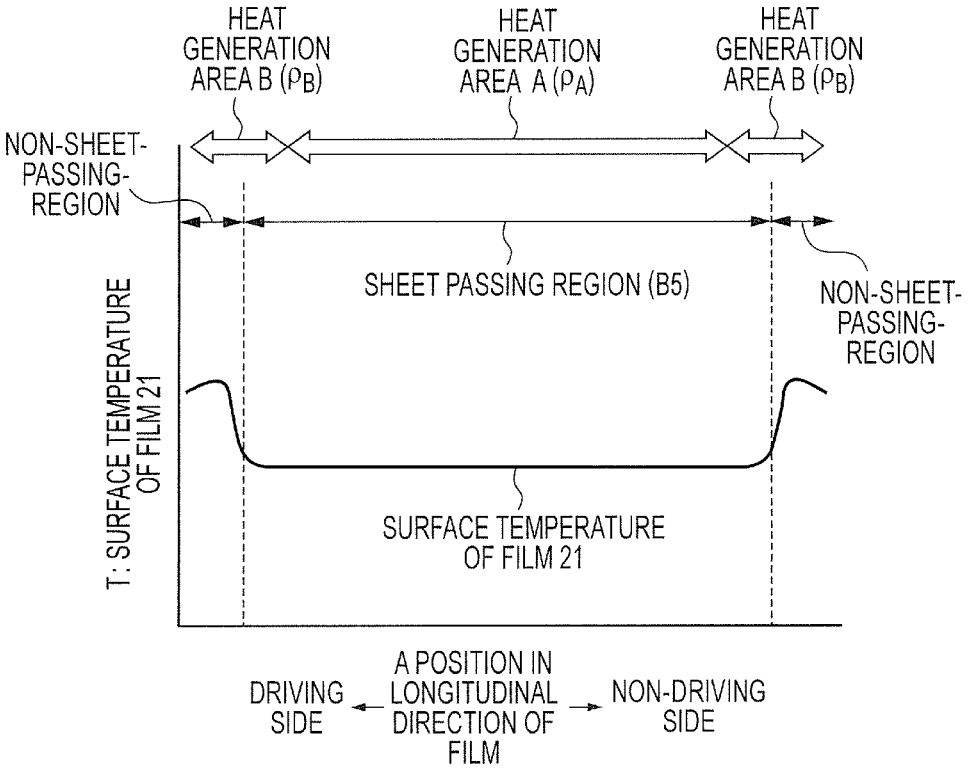
FIG. 6 is a graph for showing a temperature distribution in a film longitudinal direction when printing is continuously performed on small-sized sheets.

FIG. 6 is a graph for showing a state of the non-sheet-feeding portion temperature rise after continuous printing on thirty sheets that are B5-sized and have a sheet basis weight of 75 g/m$^2$. Because the sheets are B5-sized, electrical power is supplied to the heat generation area A and the heat generation areas B. It can be seen that the temperature of the non-sheet-feeding portions of the film 21 rises. When a temperature detection element is arranged in the heat generation areas B, the non-sheet-feeding portion temperature rise can be detected. Upsizing of the apparatus is, however, incurred. Meanwhile, when a temperature detection element is not arranged in the heat generation areas B, it is difficult to detect the temperature of the heat generation areas B using the temperature detection element TH1 in the heat generation area A.

Accordingly, in this embodiment, through detection of the resistance of the heat generation areas B using the PTC characteristics of the heat generating resistors, the temperature of the heat generation areas B is calculated. The resistance of the heat generating resistors used in this embodiment is described. The heat generating resistor 302*a*-2 and the heat generating resistor 302*b*-2 are connected in parallel in the heat generation area A, and the combined resistance $R_{A0}$ in the heat generation area A is 14 Ω (at 23° C.). Further, the heat generating resistors 302*a*-1 and 302*b*-1 and, 302*a*-3 and 302*b*-3 are connected in parallel in the heat generation areas B, respectively, and thus, the combined resistance $R_{B0}$ in each of the heat generation areas B is 35 Ω (at 23° C.).

As illustrated in FIG. 4, the printer of this embodiment includes the current detection circuit 503 configured to detect the energizing current $I_B$ to the heat generation areas B, and the voltage detection circuit 504 configured to detect the applied voltage $V_B$. These detection circuits enable calculation of a resistance $R_B$ ($=V_B/I_B$) of the heat generation areas B in energization control. In this embodiment, an arithmetic circuit unit of the control circuit 400, the current detection circuit 503, and the voltage detection circuit 504 correspond to a resistance detecting unit. In this case, the detected resistance $R_B$ of the heat generation areas B is the resistance of the entire circuit for energizing the heat generating resistors, and, although the resistances of the conductors, the resistance of the electrode, and the resistance of the cable are included, the resistances of the heat generating resistors are dominant. Therefore, the resistances of the heat generating resistors can be regarded as the resistance of the corresponding heat generation area.

Next, a temperature detecting method using temperature-resistance characteristics of the heat generating resistors 302 of the heater 300 and a controlling method as features of this embodiment are described. In this embodiment, the arithmetic circuit unit provided in the control circuit 400 corresponds to the temperature acquiring unit. As described above, the heat generating resistors 302 have the PTC characteristics, and a temperature coefficient of resistance (TCR) thereof is 1,500 parts per million (PPM). Further, the TCR value can be expressed by Expression (1). The TCR of the heat generating resistors 302 is stored in a memory (not shown) arranged in the image forming apparatus.

$$TCR=(R-R_0)/R_0\times 1/(T-T_0)\times 10^6 \quad (1).$$

where R represents a resistance at a temperature T, and $R_0$ represents a reference resistance at a reference temperature $T_0$.

Therefore, in this embodiment, the present temperature $T_B$ of the heat generation areas B can be determined from Expression (2) as a transformation of Expression (1). $R_B$ represents a present resistance of the heat generating resistors in the heat generation areas B, and $R_{B0}$ represents a resistance at the reference temperature $T_0$ of the heat generating resistors in the heat generation areas B. Further, $I_B$ represents a present current value passing through the heat generation areas B, and $V_B$ represents a present voltage value applied to the heat generation areas B.

$$T_B=(R_B-R_{B0})/(R_{B0}\times TCR\times 10^{-6})+T_0=\{(V_B/I_B)-R_{B0}\}/\{(R_{B0})\times TCR\times 10^{-6}\}+T_0=\{(V_B/I_B)-35\}/\{(R_{B0})\times 1500\times 10^{-6}\}+23 \quad (2).$$

where the temperature $T_B$ represents a temperature of an outermost layer on the back surface side of the heater 300.

Figure 7:
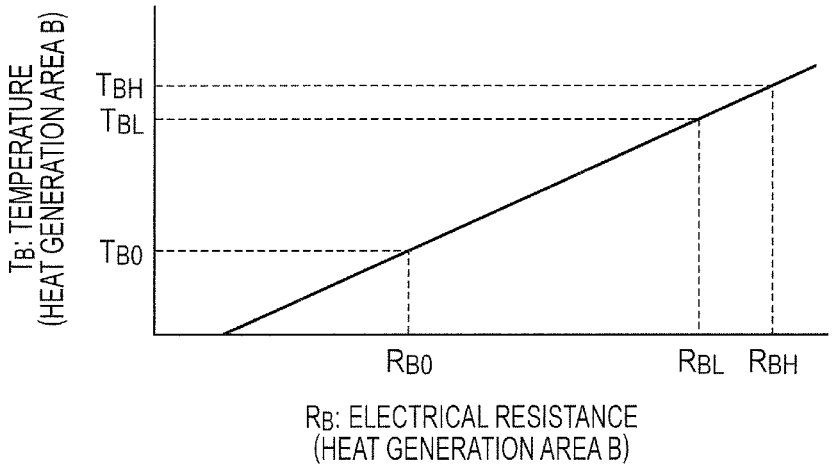
FIG. 7 is a graph for showing the correlation between an electrical resistance $R_B$ and a temperature $T_B$ of a heat generating resistor having positive temperature coefficient (PTC) characteristics.

FIG. 7 is a graph for showing the relationship between the resistance $R_B$ and the temperature $T_B$ of the heat generation areas B in this embodiment. As described above, the resistance of the heat generation areas B is the reference resistance $R_{B0}$=35 Ω at a room temperature of 23° C. ($T_0$), and is $R_{BH}$=45.9 Ω at a temperature $T_{BH}$=230° C. at which there is a risk of hot offset of the toner to a recording material P. Meanwhile, at a low temperature $T_{BL}$=170° C. at which there is a risk of insufficient fixing, the resistance of the heat generation areas B is $R_{BL}$=42.7 Ω. The temperature of the heat generation areas B having no temperature detection element in this embodiment can be detected through detection of the resistance $R_B$, and whether or not printing operation is conducted under a state in which the temperature $T_B$ calculated from the resistance $R_B$ falls within a predetermined range can be monitored.

Figure 8:
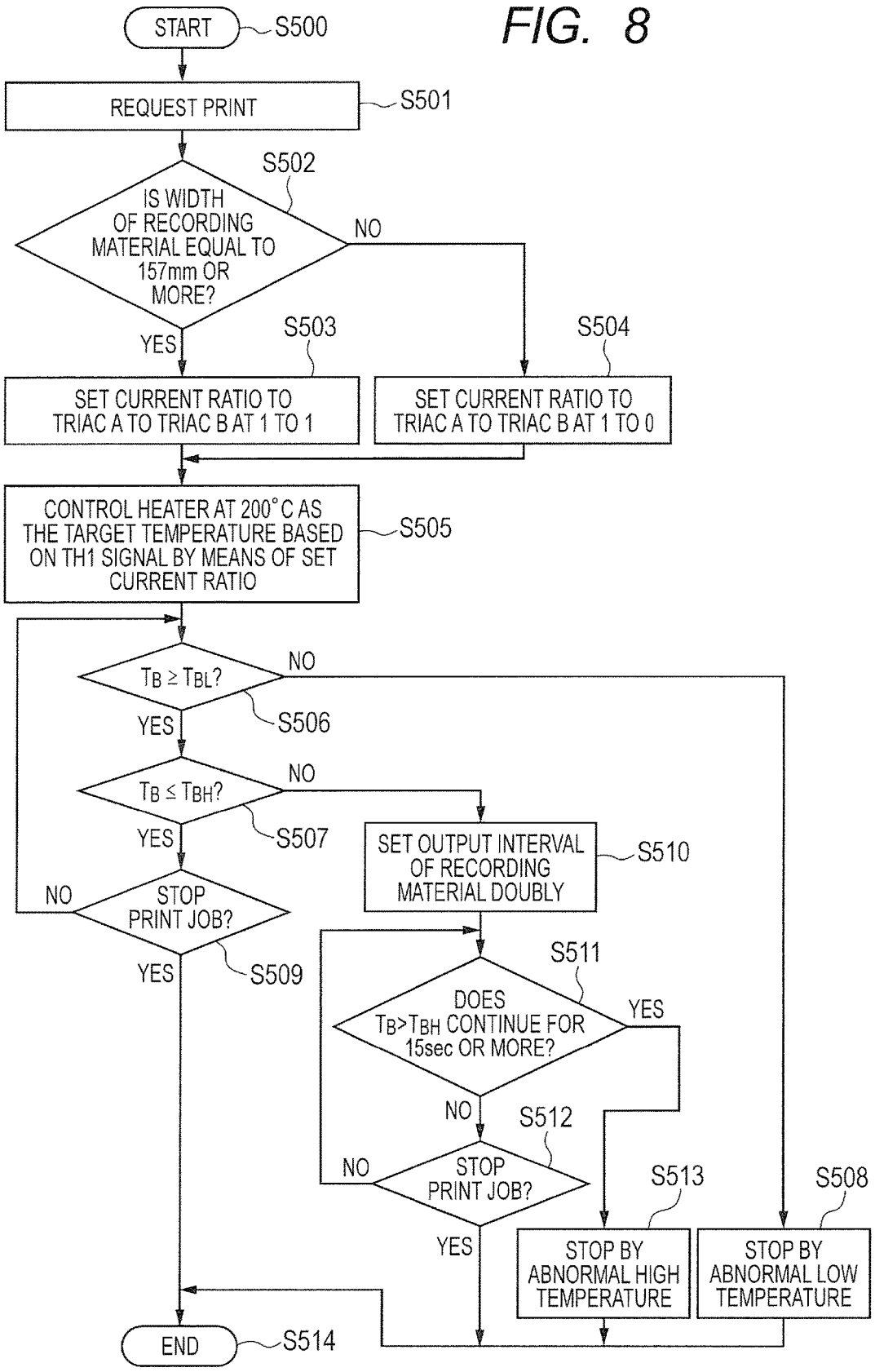
FIG. 8 is a flow chart for illustrating a control sequence of a fixing device according to the first embodiment.

FIG. 8 is a flow chart for illustrating a control sequence of the fixing device 10 by the control circuit 400. When, in step S501, printing is requested, the pressure roller 30 starts a rotating operation so as to attain an image formation process speed of 190 mm/sec. In Step S502, whether or not the recording material width is equal to or larger than a predetermined width, specifically, whether or not the recording material width is 157 mm or more is determined. In the printer of this embodiment, in the case of a letter size sheet, a legal size sheet, an A4 sheet, an executive size sheet, a B5 sheet, and a nonstandard-sized sheet having a width of 157 mm or more and fed from the sheet feed tray 8, the process proceeds to step S503. Then, a current ratio between the triac A and the triac B is set to be 1:1 (state illustrated in FIG. 5A).

When the recording material width is less than 157 mm (in this embodiment, in the case of an A5 sheet, a DL envelope, a COM 10 envelope, and a nonstandard-sized sheet having a width of less than 157 mm), the process proceeds to step S504. Then, the current ratio between the triac A and the triac B is set to be 1:0 (state illustrated in FIG. 5B).

As a method of determining the recording material width in Step S503, any method may be used including a method using a sheet width sensor provided in the sheet feed cassette 6 or the sheet feed tray 8, and a method using a sensor such as a flag provided on a conveyance path of the recording material P. Other methods include a method based on width information of the recording material P set by a user, and a method based on image information for forming an image on the recording material P.

In step S505, using the set current ratio, the fixing processing is performed under a state in which the temperature detected by the thermistor TH1 is maintained at a set target temperature of 200° C. In other words, energization of the heater is controlled so that the temperature of the heat generation area A may fall within a predetermined temperature range, specifically, may be maintained at a temperature of about 200° C.

In step S506, whether or not the temperature $T_B$ of the heat generation areas B is less than a predetermined low temperature threshold value is determined. When $T_B \geq_{BL}$ is satisfied, the process proceeds to step S507, and when $T_B<T_{BL}$ is satisfied, the process proceeds to step S508. When the process proceeds to step S508, it is determined that there is a case of failure of the fixing device 10, or erroneous detection of the size of the recording material P or erroneous setting by a user. As a failure avoiding operation, when a printing operation (conveyance of the recording material) is stopped (stop by abnormal low temperature) in step S508, the whole process is stopped in step S514.

In step S507, whether or not the temperature $T_B$ of the heat generation areas B is greater than a predetermined high temperature threshold value is determined. When $T_B \leq T_{BH}$ is satisfied, the process proceeds to step S509, and when $T_B>T_{BH}$ is satisfied, the process proceeds to step S510. In step S509, whether or not the print job is ended is determined. When the printing continues, the flow including a series of steps S506 to S509 is repeated again as a loop. When, in step S509, an end of the print job is detected, the print job ends in Step S514.

When the process proceeds to step S510, it is determined that the temperature of the non-sheet-feeding portions exceeds the predetermined upper limit, and, as a failure avoiding operation, the intervals of feeding the recording materials P when the recording materials are continuously conveyed is set doubly. Through setting of the intervals of feeding the recording materials P doubly, the temperature rise of the non-sheet-feeding portions is suppressed. Alternatively, through reduction of the image formation process speed half (reduction of the speed of conveying the recording material P by half), the output interval of the recording material P may be set doubly.

When, in step S511, a duration time (duration period) of $T_B>T_{BH}$ is less than a predetermined period (15 sec), the fixing processing continues until the end of the print job is detected in step S512. When the state of $T_B>T_{BH}$ continues for the predetermined period or more, that is, for 15 sec or more (S511), it is determined that there is a case of failure of the fixing device 10, or erroneous detection of the size of the recording material P or erroneous setting by a user. Then, as a failure avoiding operation, a printing operation (conveyance of the recording material) is stopped in step S513 (stop by abnormal high temperature).

In this embodiment, as the temperature threshold values $T_{BL}$ and $T_{BH}$ for detecting an abnormality, fixed values are used, but the values may be changed depending on the width or the basis weight of the recording material P.

As described above, the temperature of the heat generation areas B can be detected from the resistance $R_B$ of the heat generation areas B in which no temperature detection element is arranged. This enables provision of an image forming apparatus that can monitor the temperatures of the respective heat generation areas without arranging a temperature detection element in each of the heat generation areas.

In this embodiment, a description was made of, as an example, a case of a center-referenced image forming apparatus in which the recording material P is conveyed under a state in which the center of the recording material P in the width direction is aligned with the conveyance reference X set in the center of the heater longitudinal direction. The temperature detecting method as in this embodiment may, however, also be applied to a side-referenced image forming apparatus in which one end of the heater in the longitudinal direction (one end of the heat generation area in the heater longitudinal direction) is set as the conveyance reference and a recording material P is conveyed with one side of the recording material P in parallel with the recording material conveyance direction being aligned with the conveyance reference. In this case, the heater has the structure in which the heat generation area (heat generation block) A for generating heat, irrespective of the size of the recording material P is formed at an end portion of the heater on the conveyance reference side, and the heat generation area B is formed at a location farther than the heat generation area A from the conveyance reference. The same holds true also in modifications and embodiments described below.

First Modification

Figure 9A:
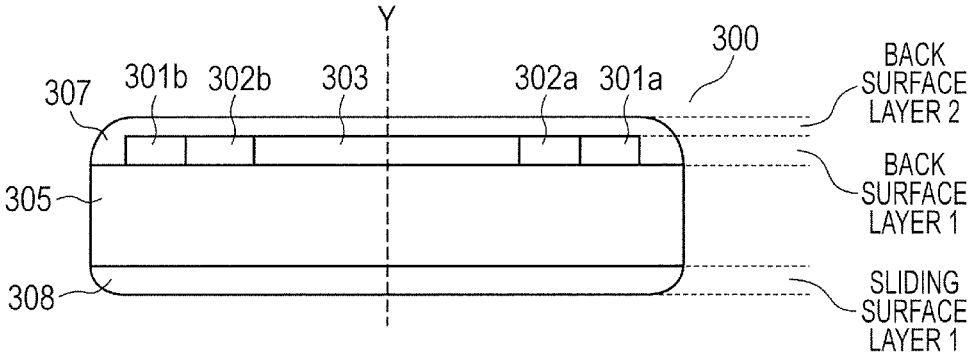
FIG. 9A is a structural view of a heater of a first modification of the first embodiment and is a sectional view taken along line 9A-9A of FIG. 9B.
Figure 9B:
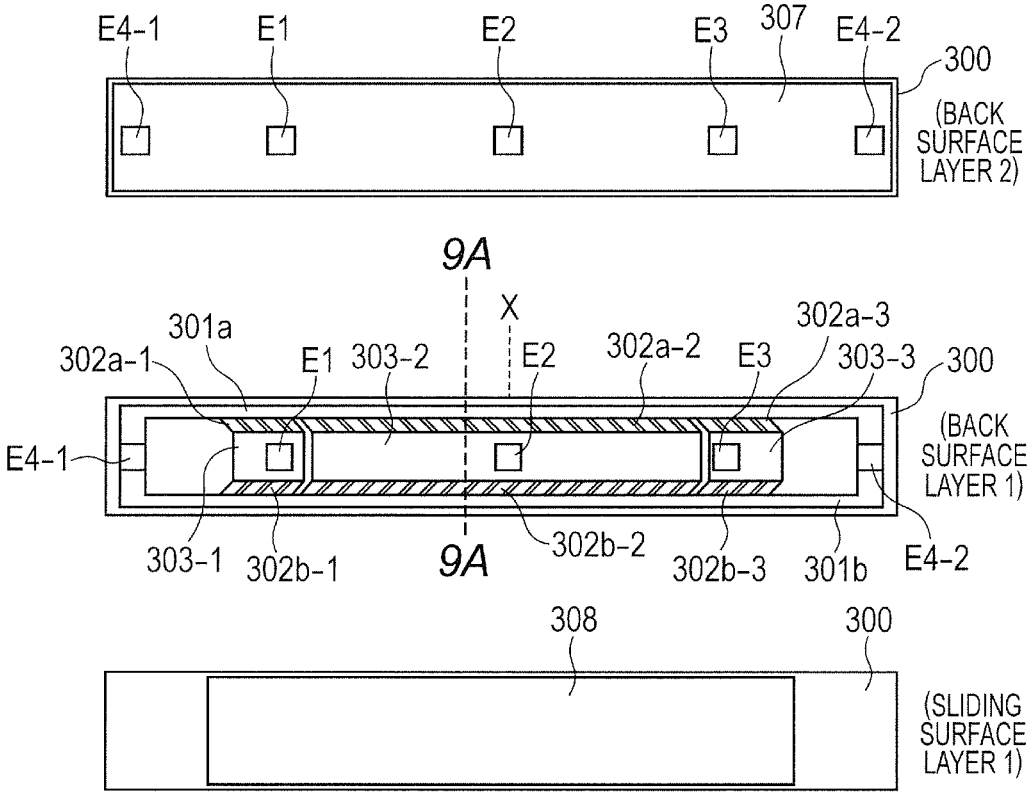
FIG. 9B is a structural view of a heater of a first modification of the first embodiment.

FIG. 9A and FIG. 9B are schematic views for illustrating the structure of the heater according to a first modification of this embodiment. FIG. 9A is a sectional view of the heater 300 taken along line 9A-9A of FIG. 9B, taken along its lateral direction that is in parallel with the recording material conveyance direction. The first modification of this embodiment may have the structure illustrated in FIG. 9A and FIG. 9B. Specifically, the heat generating resistors are skipped and are formed spatially intermittently, and are connected in parallel to the conductors. Specifically, the heat generating resistors forming the respective heat generation blocks are formed as heat generation member groups in each of which a plurality of heat generation members extending in a slanted direction with respect to the lateral direction are spaced in the longitudinal direction between conductor pairs arranged on both sides in the recording material conveyance direction (lateral direction) on the substrate. In each of the heat generation member groups, the heat generation members are arranged so that heat generation ranges of adjacent heat generation members may overlap in the longitudinal direction, that is, so that the heat generation ranges may have regions overlapping each other as seen from the lateral direction, in order that no gap may be formed in the longitudinal direction in the heat generation area of each of the heat generation member groups.

Through reduction of the areas of the heat generating resistors in this way, a generated heat amount equivalent to that of this embodiment can be achieved using a heat generating resistor paste material having a lower sheet resistance. In general, with regard to a heat generating resistor paste material having the PTC characteristics, as the sheet resistance becomes lower, the PTC characteristics become higher. When, as in this embodiment, the temperature is detected using the resistance-temperature characteristics of the heat generating resistors, as the absolute value of the TCR value becomes larger, the accuracy of the detection can be improved more. Further, through formation of the respective heat generating resistors connected in parallel so as to be slanted with respect to the lateral direction, the generated heat amounts in the longitudinal direction can be made uniform. The more suitable structure including this embodiment may be selected depending on the sheet resistance of the heat generating resistors used. In other words, various kinds of structures may be adopted insofar as the energization is performed using conductor pairs arranged at different locations in the heater lateral direction, the heat generation areas of the entire heater can be formed without a gap in the longitudinal direction, and still, the footprints of the heat generating resistors can be reduced.

Second Modification

Figure 10A:
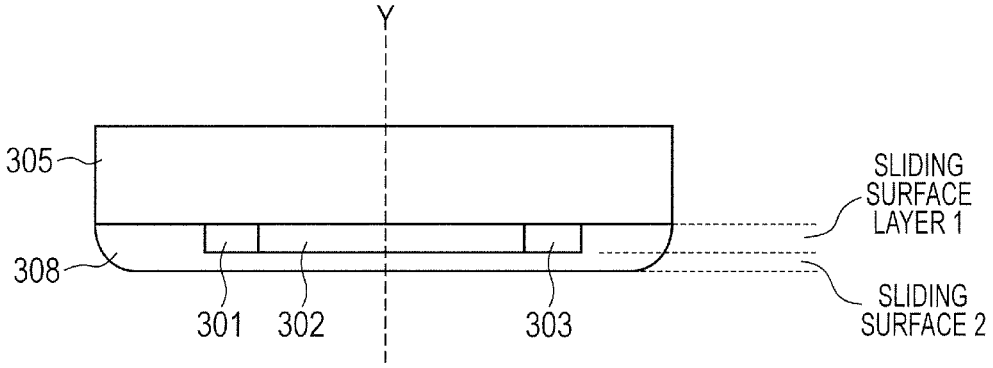
FIG. 10A is a structural view of a heater of a second modification of the first embodiment and is a sectional view taken along line 10A-10A of FIG. 10B.
Figure 10B:
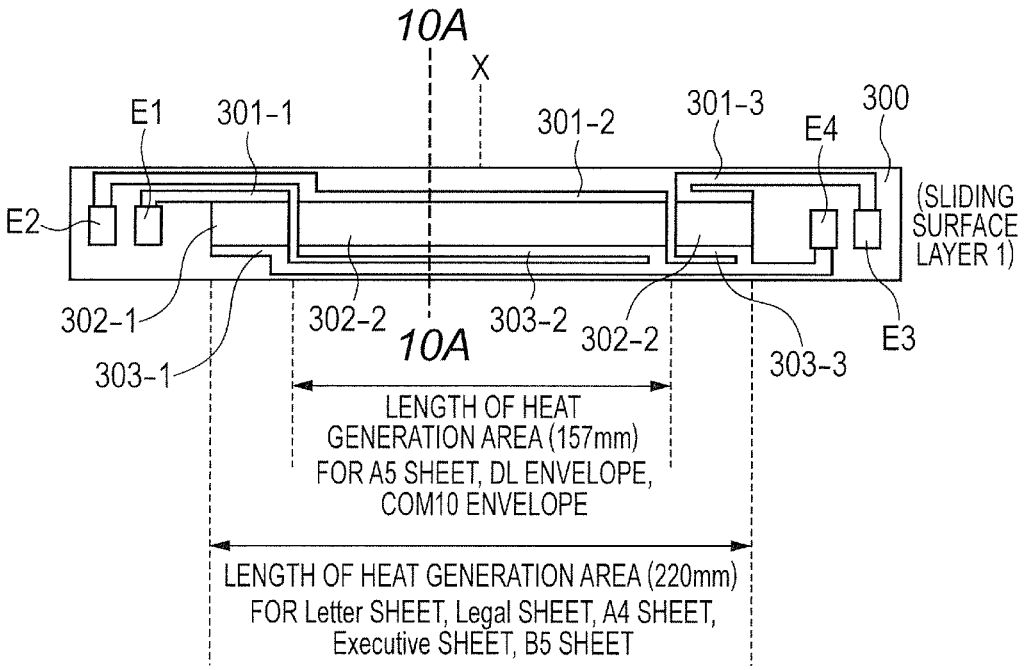
FIG. 10B is a structural view of a heater of a second modification of the first embodiment.

FIG. 10A and FIG. 10B are schematic views for illustrating the structure of the heater according to a second modification of this embodiment. FIG. 10A is a sectional view of the heater 300 taken along line 10A-10A of FIG. 10B, taken along its lateral direction that is in parallel with the recording material conveyance direction. The second modification of this embodiment may have the structure illustrated in FIG. 10A and FIG. 10B. Specifically, the heat generating resistors, the conductors, and the electrodes are arranged on the sliding surface side (sliding surface layer 1 side) with respect to the film 21, that is, a surface of the substrate 305 opposed to the film 21. Through use of the structure of the second modification, heat generated from the heat generating resistors can be transferred to the film 21 faster, and thus, the fixing device can be heated faster to reduce a first print out time (FPOT). In view of a limitation on the printer body size and required performance such as FPOT, the more suitable structure including this embodiment may be selected.

Third Modification

Figure 11A:
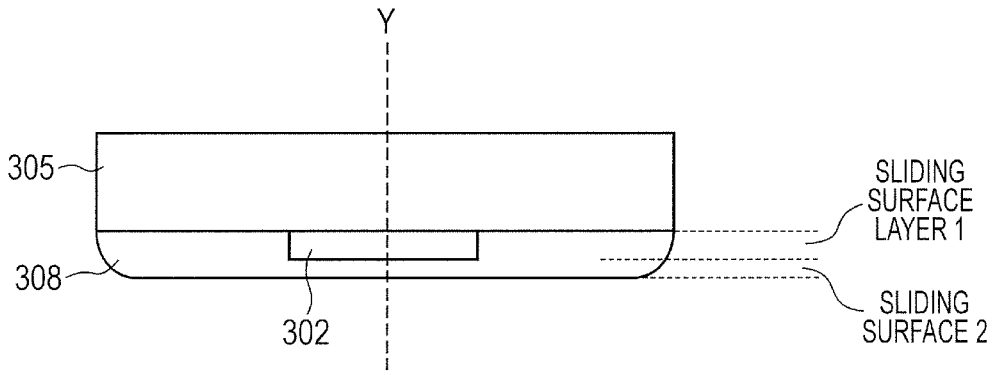
FIG. 11A is a structural view of a heater of a third modification of the first embodiment and is a sectional view taken along line 11A-11A of FIG. 11B.
Figure 11B:
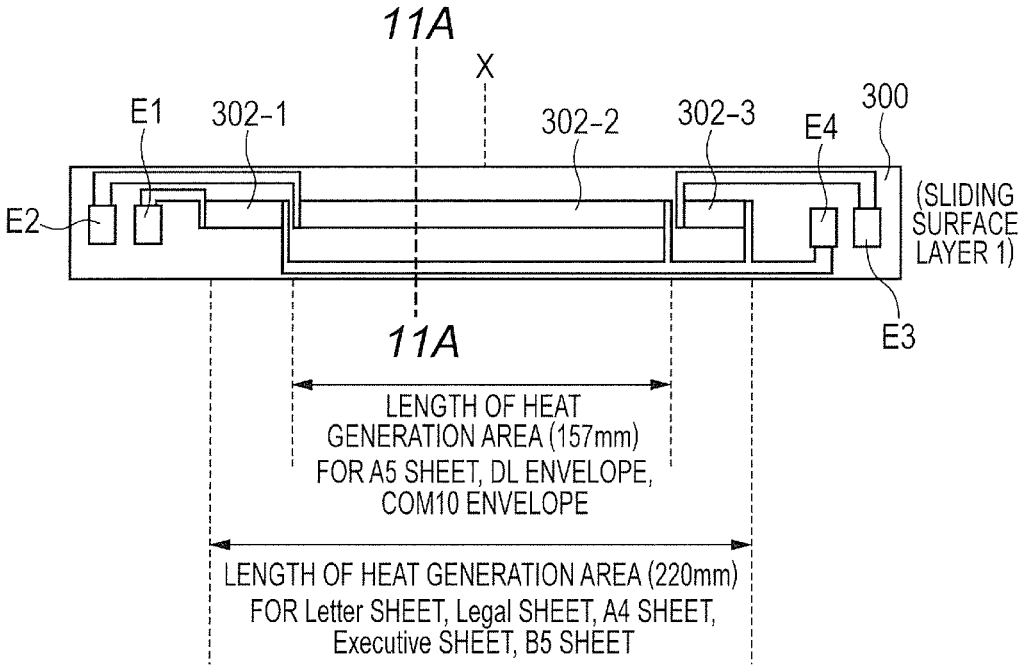
FIG. 11B is a structural view of a heater of a third modification of the first embodiment.

FIG. 11A and FIG. 11B are schematic views for illustrating the structure of the heater according to a third modification of this embodiment. FIG. 11A is a sectional view of the heater 300 taken along line 11A-11A of FIG. 11B, taken along its lateral direction that is in parallel with the recording material conveyance direction. The third modification of this embodiment may have the structure illustrated in FIG. 11A and FIG. 11B. While this embodiment has the structure in which the heat generating resistors are energized in the conveyance direction, the third modification has the structure in which the heat generating resistors are energized in the longitudinal direction. Further, in this embodiment, the heat generating resistors having the PTC characteristics are used. In the third modification, however, heat generating resistors having negative temperature coefficient (NTC) characteristics were used. Through use of the heat generating resistors having NTC characteristics in the structure in which the energization is performed in the longitudinal direction, an effect similar to that of the structure in which the heat generating resistors having the PTC characteristics are energized in the conveyance direction can be obtained. Specifically, in the case of the NTC characteristics, a resistance at a location at which the temperature rises becomes lower. Thus, when the energization is performed in the longitudinal direction, the generated heat amount becomes smaller than that in other locations, and the effect of reducing the temperature rise can be obtained.

Figure 12:
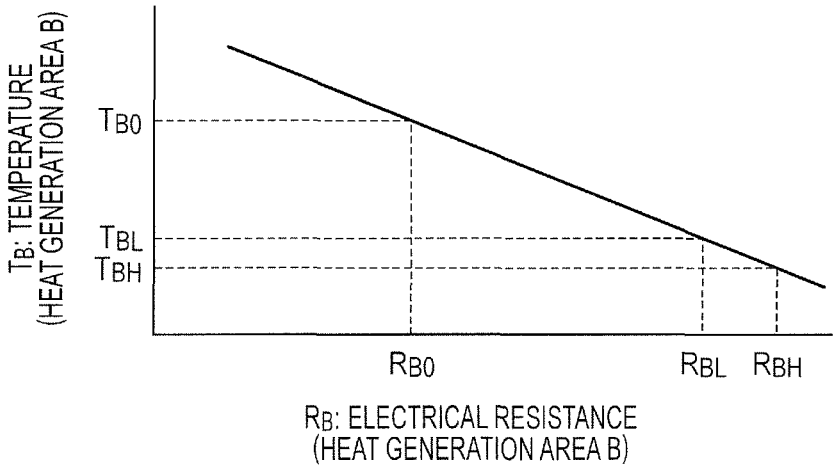
FIG. 12 is a graph for showing the correlation between an electrical resistance RB and a temperature TB of a heat generating resistor having negative temperature coefficient (NTC) characteristics.

FIG. 12 is a graph for showing the correlation between the electrical resistance $R_B$ and the temperature $T_B$ of a heat generating resistor having the NTC characteristics. Also, through use of the heat generating resistor having the NTC characteristics, the temperature can be detected from the resistance of the heat generating resistor as shown in FIG. 12. The more suitable structure including this embodiment may be selected depending on the temperature-resistance characteristics (TCR) of the heat generating resistors used.

Fourth Modification

Figure 13A:
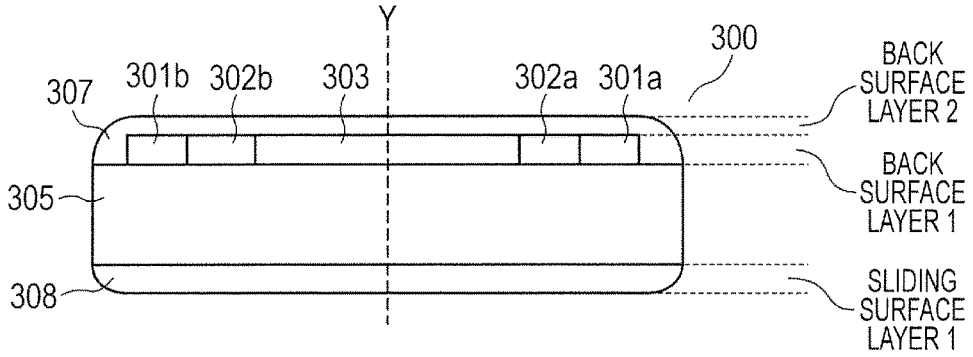
FIG. 13A is a structural view of a heater of a fourth modification of the first embodiment and is a sectional view taken along line 13A-13A of FIG. 13B.
Figure 13B:
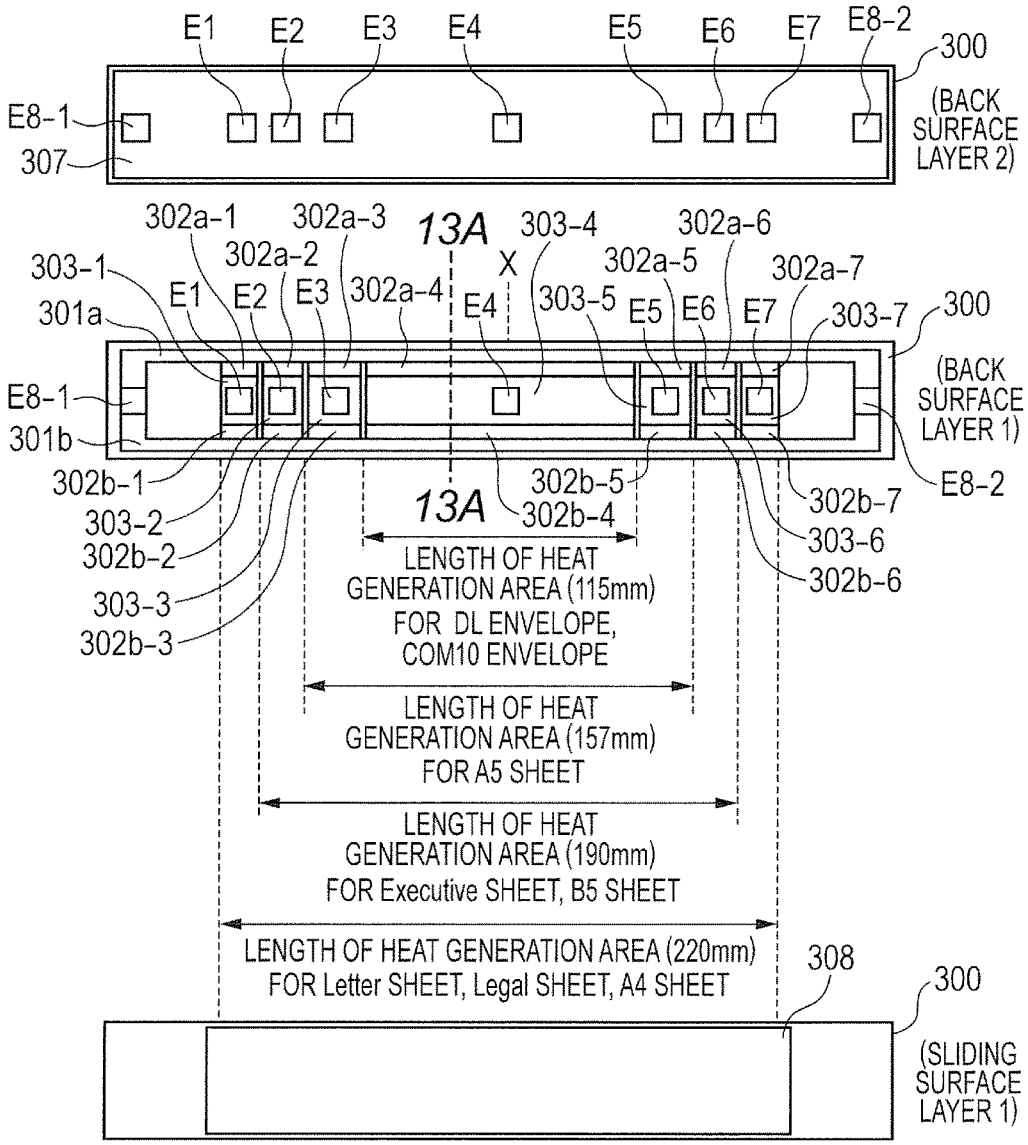
FIG. 13B is a structural view of a heater of a fourth modification of the first embodiment.

FIG. 13A and FIG. 13B are schematic views for illustrating the structure of the heater according to a fourth modification of this embodiment. FIG. 13A is a sectional view of the heater 300 taken along line 13A-13A of FIG. 13B, taken along its lateral direction that is in parallel with the recording material conveyance direction. The fourth modification of this embodiment may have the structure illustrated in FIG. 13A and FIG. 13B. Specifically, a plurality of heat generation blocks (second heat generation members) for enlarging the heat generation area of the heat generation block in the center (first heat generation members) are formed in the longitudinal direction, and a greater number of independently controllable heat generation areas are formed.

A heat generation block (heat generation members 302*a*-4 and 302*b*-4) arranged in the longitudinal center including the conveyance reference X of the recording material is energized via electrodes E4, E8-1, and E8-2, the first conductors 301*a* and 301*b*, and a second conductor 303-4 to generate heat, and forms a heat generation area of 115 mm. Two heat generation blocks are arranged on both sides thereof, respectively. One of the two heat generation blocks (heat generation members 302*a*-3 and 302*b*-3) is energized via the electrodes E3, E8-1, and E8-2, the first conductors 301*a* and 301*b*, and the second conductor 303-3 to generate heat. Another heat generation block (heat generation members 302*a*-5 and 302*b*-5) is energized via electrodes E5, E8-1, and E8-2, the first conductors 301*a* and 301*b* , and a second conductor 303-5 to generate heat. These three heat generation blocks form a heat generation area of 157 mm. Further, two heat generation blocks are arranged on both sides thereof, respectively. One of the two heat generation blocks (heat generation members 302*a*-2 and 302*b*-2) is energized via the electrodes E2, E8-1, and E8-2, the first conductors 301*a* and 301*b*, and the second conductor 303-2 to generate heat. Another heat generation block (heat generation members 302*a*-6 and 302*b*-6) is energized via electrodes E6, E8-1, and E8-2, the first conductors 301*a* and 301*b*, and a second conductor 303-6 to generate heat. These five heat generation blocks form a heat generation area of 190 mm. Still further, two heat generation blocks are arranged on both sides thereof, respectively. One of the two heat generation blocks (heat generation members 302*a*-1 and 302*b*-1) is energized via the electrodes E1, E8-1, and E8-2, the first conductors 301*a* and 301*b*, and the second conductor 303-1 to generate heat. Another heat generation block (heat generation members 302*a*-7 and 302*b*-7) is energized via electrodes E7, E8-1, and E8-2, the first conductors 301*a* and 301*b*, and a second conductor 303-7 to generate heat. These seven heat generation blocks form a heat generation area of 220 mm.

Having more fragmented heat generation areas in this way enables more precise selective energization control of the sheet-feeding unit, and thus, depending on the sheet size, there is an effect of further suppressing the non-sheet-feeding portion temperature rise. Further, in detecting the temperature using the temperature-resistance characteristics of the heat generating resistors, through division of the heat generation area into more blocks, the longitudinal range of each of the heat generation areas is reduced to enable detection of a more local temperature rise. The more suitable structure including this embodiment may be selected depending on the corresponding sheet size, a limitation on the structure of the fixing device, and the costs.

Second Embodiment

A second embodiment of the present invention is described. Here, points in the second embodiment that are different from those in the first embodiment are mainly described, and a description of the structures similar to those in the first embodiment is omitted. Points in the second embodiment that are not specifically described here are similar to those in the first embodiment.

Figure 14:
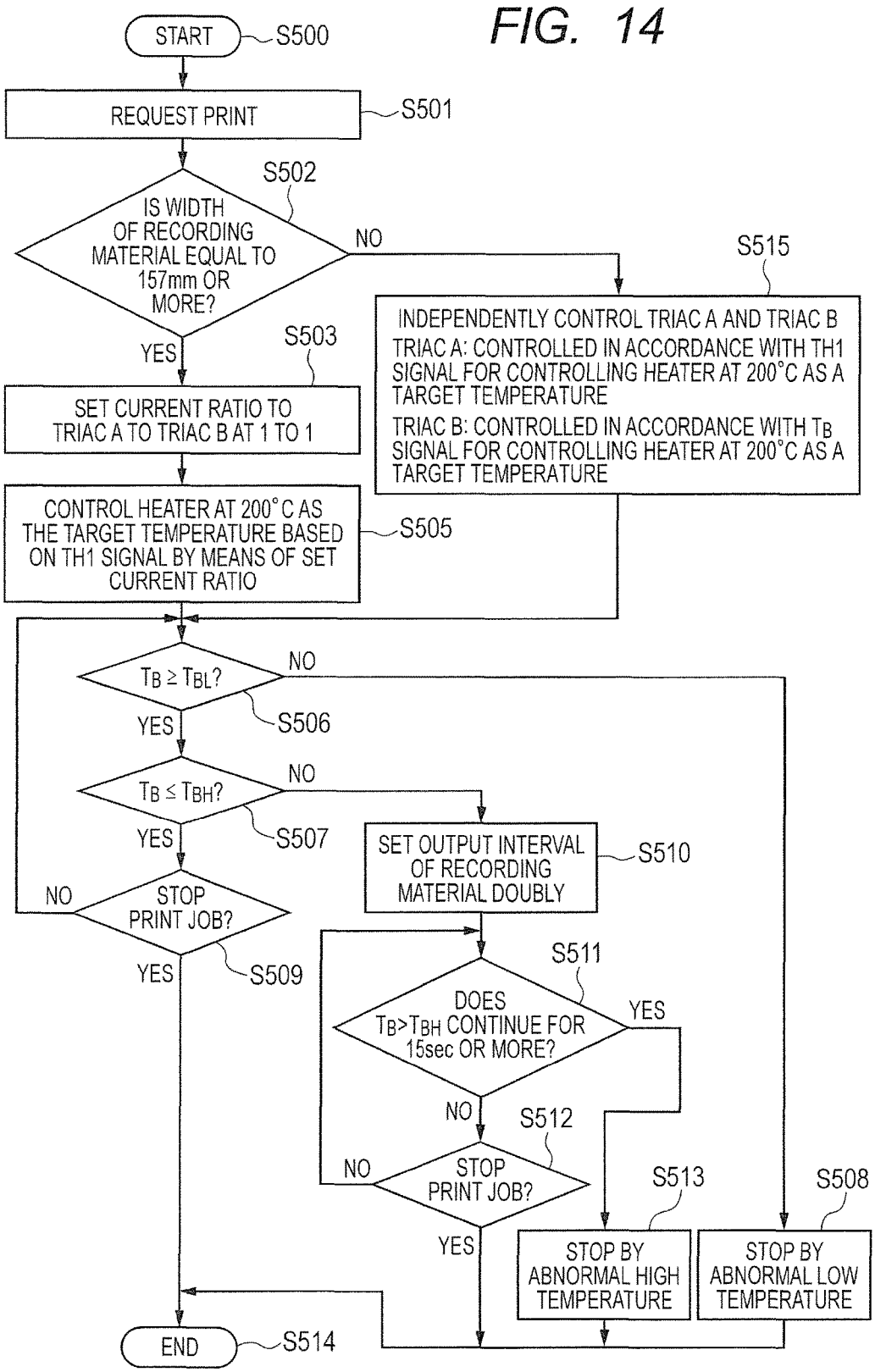
FIG. 14 is a flow chart for illustrating a control sequence of a fixing device according to a second embodiment of the present invention.

FIG. 14 is a flow chart for illustrating a control sequence of the fixing device 10 of the second embodiment. In the first embodiment, a ratio between a current to the triac A and a current to the triac B determined in advance in accordance with the recording material width was used to control the energization of the respective heat generation areas based on the thermistor TH1. In this embodiment, as illustrated in FIG. 14, the triac A and the triac B are independently controlled only when the recording material width is less than 157 mm. Specifically, the energization of the triac A is controlled based on the thermistor TH1, while the energization of the triac B is controlled based on the resistance $R_B$ of the heat generation areas B so that the temperature $T_B$ determined from the resistance $R_B$ may be constant (S515).

When the recording material width is 157 mm or more, similarly to the case of the first embodiment, the current ratio between the triac A and the triac B is 1:1 (S503). Steps other than S515 in the flow chart of FIG. 14 are similar to step S500 to step S514 in the flow chart of FIG. 8.

Figure 15A:
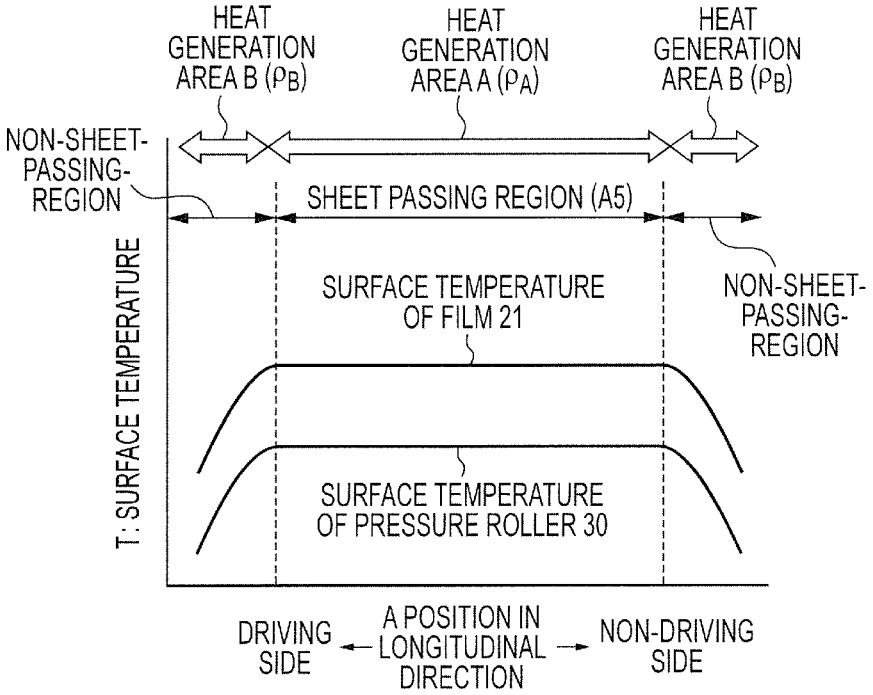
FIGS. 15A and 15B are graphs for showing a temperature distribution in a film longitudinal direction when printing is continuously performed on the small-sized sheets.

FIG. 15A is a graph for showing longitudinal temperature distributions of the film 21 and the pressure roller 30 after continuous printing on thirty sheets that are A5-sized and have a sheet basis weight of 75 g/m$^2$ using the current ratio control of the first embodiment. The current ratio between the triac A and the triac B is 1:0. It can be seen that the surface temperatures at both end portions of the film 21 and of the pressure roller 30 are very low. The outer diameter of the pressure roller 30 varies due to thermal expansion of the elastic layer 30*b*. When the surface temperatures at both end portions thereof are very low compared with that in the longitudinal center portion thereof, as in FIG. 15A, there is a big difference in outer diameter between the longitudinal center portion and the longitudinal end portions of the pressure roller 30. There is a possibility that, due to the difference in outer diameter in the pressure roller 30, the film 21 rotated following the pressure roller 30 may be twisted and cannot be rotated with stability.

Figure 15B:
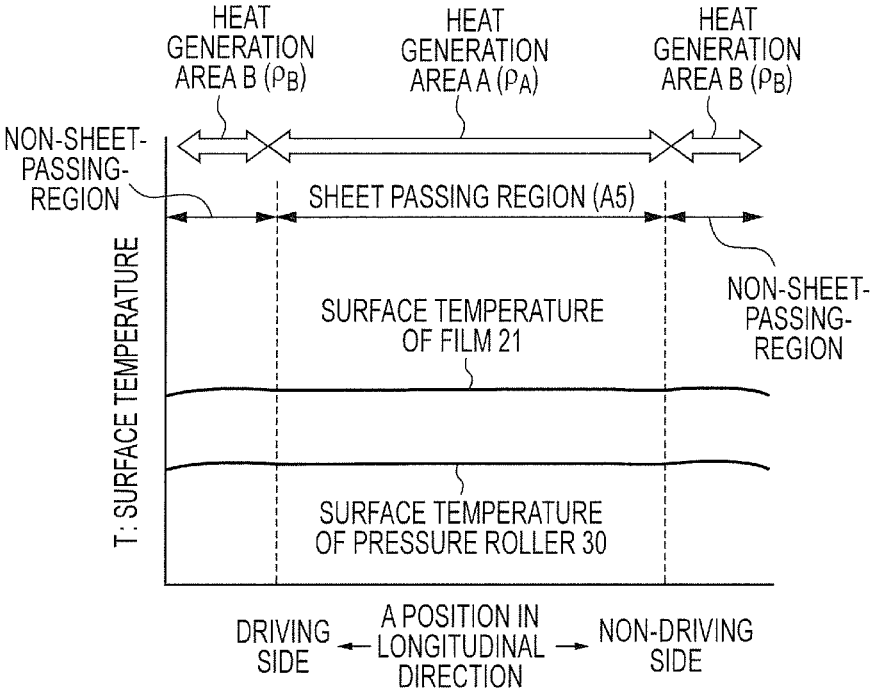

FIG. 15B is a graph for showing the control of the second embodiment, that is, longitudinal temperature distributions of the film 21 and the pressure roller 30 after continuous printing on thirty sheets that are A5-sized and have a sheet basis weight of 75 g/m$^2$ when the heat generation area A is controlled using the temperature detected by the thermistor TH1 and the heat generation areas B are controlled using the calculated temperature $T_B$. In this case, the control was exerted so that the back surface of the heater may be at about 200° C. with a control target $R_{BTGT}$ of the resistance $R_B$ of the heat generation areas B being 44.3 Ω. As a result, the temperature of the non-sheet-feeding portions of the pressure roller 30 is held to be equivalent to that of the sheet-feeding unit to reduce the difference in outer diameter between the longitudinal center portion and the longitudinal end portions of the pressure roller 30. Thus, the film 21 can be rotated with stability.

In this embodiment, selection was made whether the triac B is controlled based on the temperature detected by the thermistor TH1 or based on the resistance $R_B$ in accordance with the recording material width, but the triac B may be controlled based on the resistance $R_B$ irrespective of the recording material width. Specifically, as illustrated in a flow chart of FIG. 16, step S502, step S503, and step S505 may be eliminated from the flow chart of FIG. 14 in the series of flow.

Figure 16:
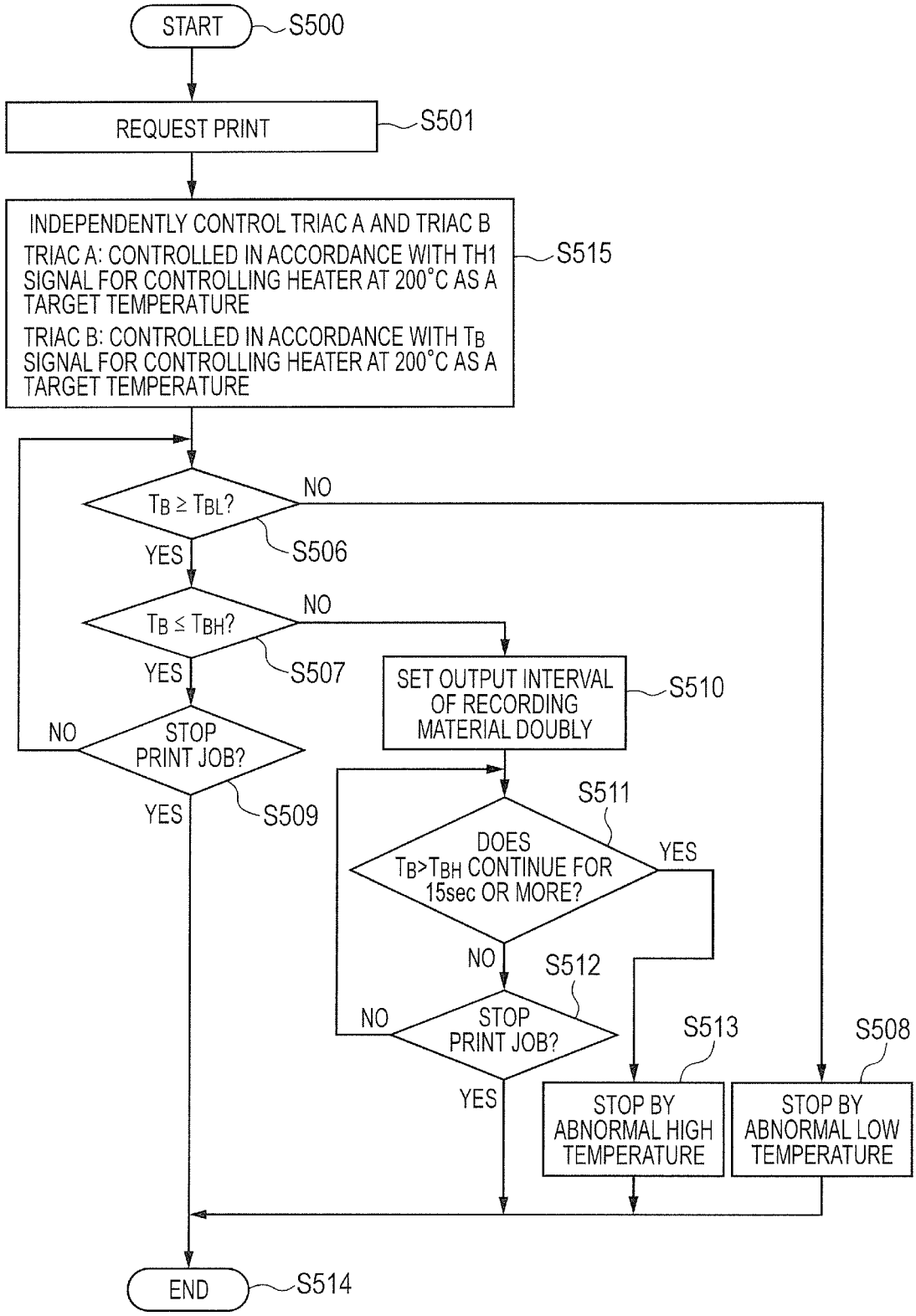
FIG. 16 is a flow chart for illustrating the control sequence of the fixing device according to the second embodiment.
Figure 17A:
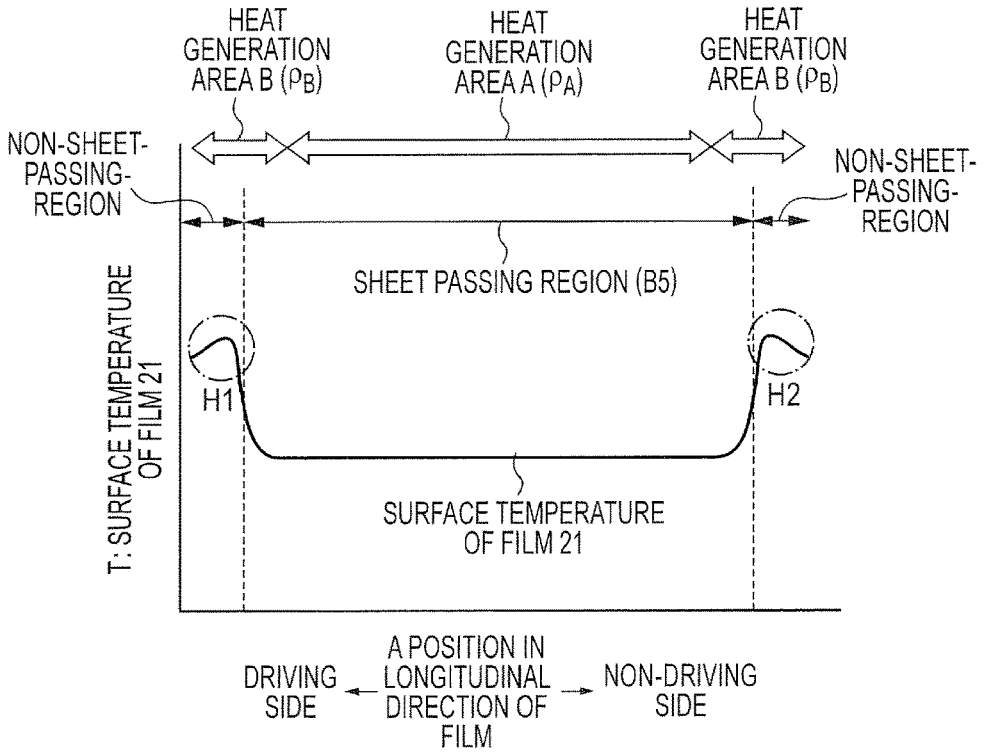
FIGS. 17A and 17B are graphs for showing the temperature distribution in the film longitudinal direction when printing is continuously performed on the small-sized sheets.
Figure 17B:
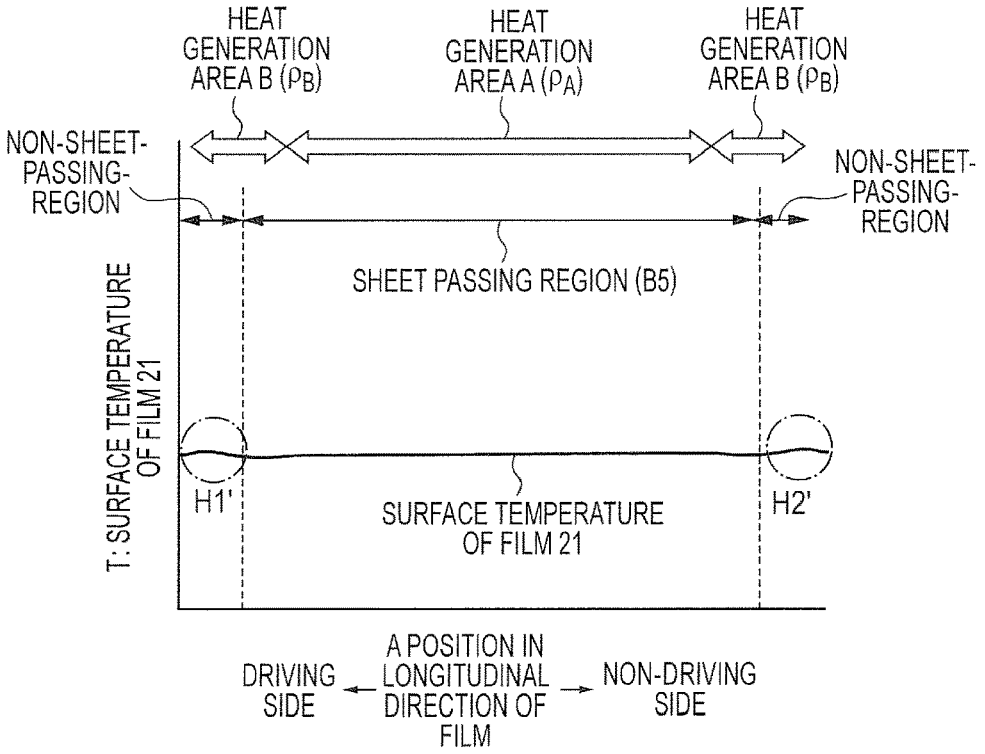

As shown in FIG. 17A, in particular, in the case of a thick sheet having a basis weight of 105 g/m$^2$ or more and the like, the non-sheet-feeding portion temperature rise is to a large extent (H1 and H2), and there is a risk of damage to the fixing members (film 21 and pressure roller 30). In such a case, through exertion of this energization control (FIG. 16), the temperature of the non-sheet-feeding portions can be always controlled to be at an appropriate temperature. As a result, as shown in FIG. 17B, the non-sheet-feeding portion temperature rise can be suppressed significantly (H1' and H2').

With regard to the energization control of the first embodiment (FIG. 8) or the energization control of the second embodiment (FIG. 14 or FIG. 16), in view of the corresponding sheet size, the sheet basis weight, a limitation on the structure of the fixing device, and the costs, a more suitable energization control may be selected.

Third Embodiment

A third embodiment of the present invention is described. Here, points in the third embodiment that are different from those in the first and second embodiments are mainly described, and description of the structures similar to those in the first and second embodiments is omitted. Points in the third embodiment that are not specifically described here are similar to those in the first and second embodiments. The fixing device of the first embodiment acquired the temperature of the heat generation areas B based on the resistance-temperature characteristics and the resistance of the heat generating resistors in the heat generation areas B. Meanwhile, in this embodiment, the temperature of the heat generation areas B is detected based on the temperature detected by the temperature detection element TH1 arranged in the sheet-feeding unit and difference in resistance of the heat generating resistors between the heat generation area A having the temperature detection element therein and the heat generation areas B having no temperature detection element therein.

Figure 20:
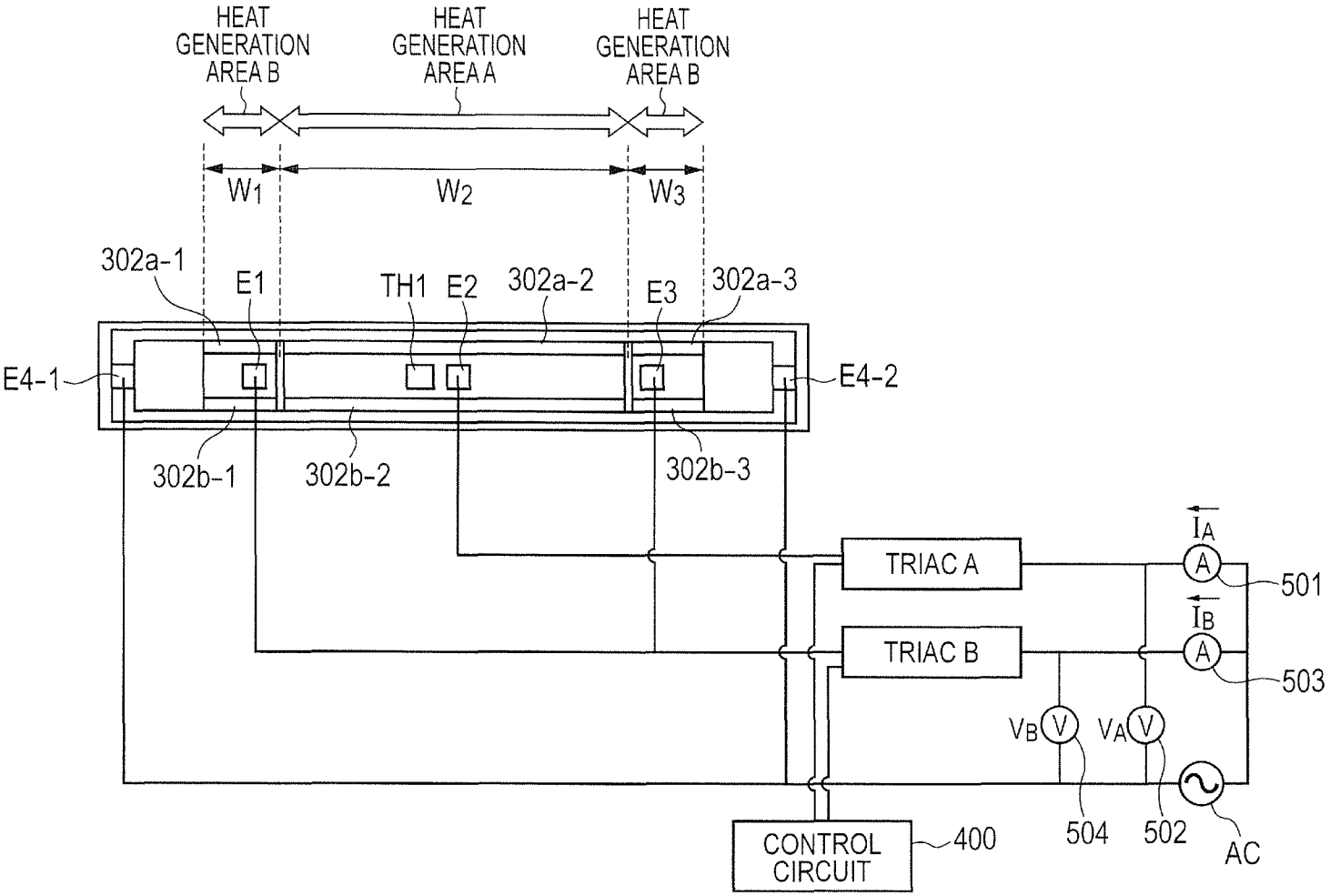
FIG. 20 is an electrical power control circuit diagram according to the third embodiment.

FIG. 20 is a diagram of an electrical power control circuit of the third embodiment. This circuit is different from the electrical power control circuit of FIG. 4 (first embodiment) in that a current detection circuit 501 and a voltage detection circuit 502 corresponding to the heat generation area A are added. The current detection circuit 501 and the voltage detection circuit 502 correspond to a second resistance detecting unit.

A temperature detecting method of the heat generation areas B in this embodiment is described. In this case, the temperature $T_B$ of the heat generation areas B is detected from a temperature $T_A$ detected by the thermistor TH1 that is arranged in the heat generation area A and a difference $\rho_\Delta$between an electrical resistivity $\rho_A$ of the heat generation area A and an electrical resistivity $\rho_B$ of the heat generation areas B ($\rho_\Delta=\rho_B-\rho_A$). The electrical resistivities $\rho_A$ and $\rho_B$ are resistivities of the heat generating resistors in the heater lateral direction in a unit area in the heater longitudinal direction. The electrical resistivities $\rho_A$ and $\rho_B$ are calculated from Expression (3-1) and Expression (3-2) using a resistance $R_A$ of the heat generation area A and the resistance $R_B$ of the heat generation areas B. The resistance $R_A$ can be, similarly to the case of the calculation expression of resistance $R_B$, calculated using a current $I_A$ detected by the current detection circuit 501 and a voltage $V_A$ detected by the voltage detection circuit 502.

$$\rho_A=R_A D W_2/L \quad \text{(3-1) and}$$

$$\rho_B=R_B D(W_1+W_3)/L \quad \text{(3-2),}$$

where $R_A$ represents a total resistance of the heat generation area A, $R_B$ represents a total resistance of the heat generation areas B, D represents a thickness of the heat generating resistors, $W_1$, $W_2$, and $W_3$ represent widths of the respective heat generation areas in the heater longitudinal direction, and L represents a width of the heat generating resistors in the heater lateral direction. In this embodiment, D=10 μm and L=1.0 mm are satisfied, which are the same for all the heat generation blocks. Further, as illustrated in FIG. 4, the width $W_2$ of the heat generation block 302-2 is 157 mm. Further, both the width $W_1$ of the heat generation block 302-1 and the width $W_3$ of the heat generation block 302-3 are 31.5 mm.

Figure 18:
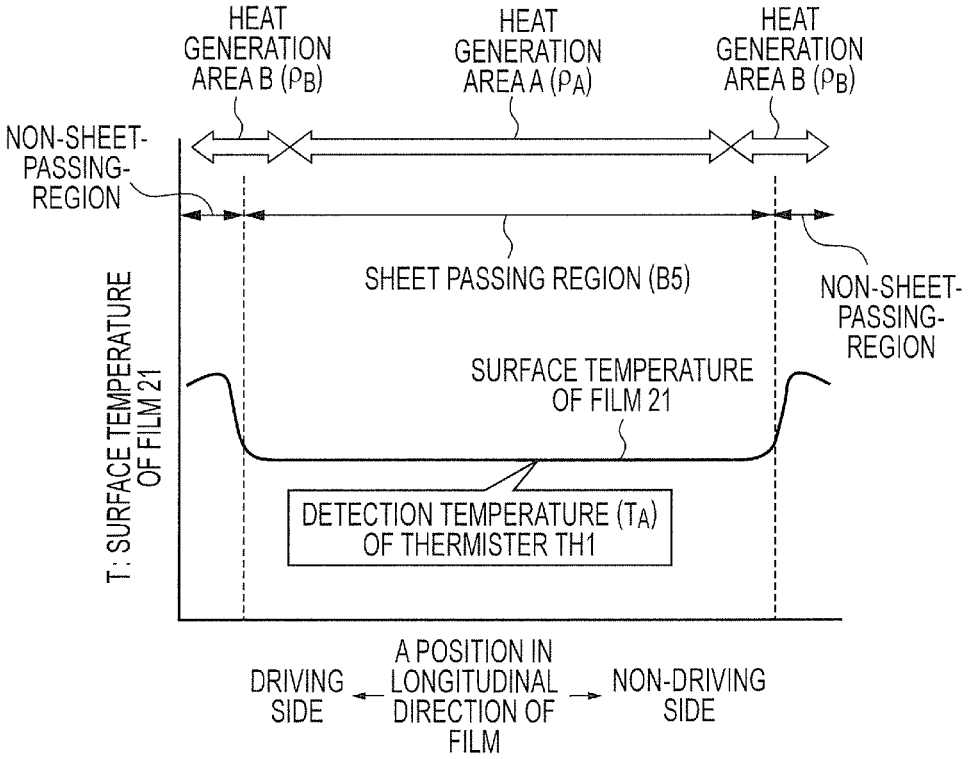
FIG. 18 is a graph for showing the temperature distribution in the film longitudinal direction when printing is continuously performed on the small-sized sheets.

FIG. 18 is a graph for showing a longitudinal temperature distribution of the film in continuous printing on small-sized sheets, and for showing a case of a temperature rise of the heat generating resistors 302.

Figure 19:
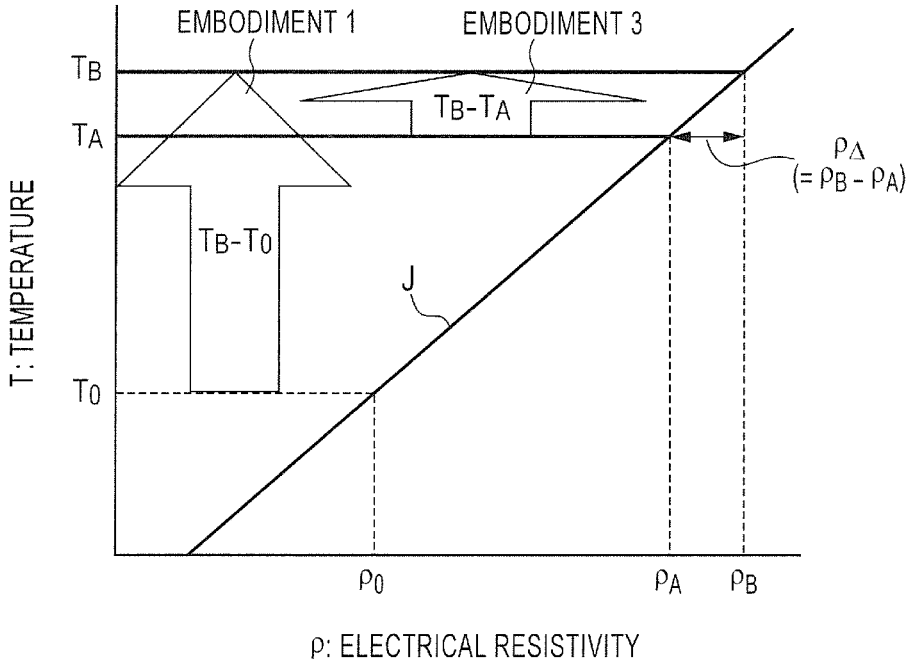
FIG. 19 is an explanatory diagram of a temperature detecting method according to a third embodiment of the present invention.

FIG. 19 is a graph for showing the correlation between the electrical resistivity ρ and the temperature T of a heat generating resistor having the PTC characteristics, for showing an exemplary temperature detecting method according to this embodiment. As shown in FIG. 19, the temperature $T_B$ of the heat generation areas B can be acquired from the temperature $T_A$ detected by the thermistor TH1, the electrical resistivity $\rho_A$ of the heat generation area A, the electrical resistivity $\rho_B$ of the heat generation areas B, the difference $\rho_\Delta$in electrical resistivity ($\rho_\Delta=\rho_B-\rho_A$), and the TCR characteristics of the heat generating resistors.

The temperature $T_B$ of the heat generation areas B is specifically calculated as in Expression (4). In FIG. 19, a line segment J represents the relationship between the electrical resistivity ρ and the temperature of the heat generation area.

$$T_B(\rho_\Delta)/(\rho_A\times TCR)+T_A=(\rho_\Delta)/(\rho_A\times 1500\times 10^{-6})+T_A \quad (4).$$

Based on the temperature $T_B$ of the heat generation areas B calculated in this way, using a control sequence similar to that of the first embodiment illustrated in FIG. 8, the heater is controlled.

In the first embodiment, the temperature of the heat generation areas B is detected from the resistance $R_{B0}$ at $T_0$ (23° C.) and the TCR value. When Expression (2) in the first embodiment is transformed using the electrical resistivity ρ, Expression (5) is obtained.

$$T_B=\{(R_B-R_{B0})\times(W_1+W_3)\}/\{(R_{B0}\times TCR)\times(W_1+W_3)\}+T_0=(\rho_B-\rho_{B0})/(\rho_{B0}\times TCR)+T_0=(\rho_B-\rho_{B0})/(\rho_{B0}\times 1500\times 10^{-6})+T_0 \quad (5).$$

Comparison is made between Expression (4) in this embodiment and Expression (5) in the first embodiment. In the first embodiment, the room temperature (23° C.) is the reference temperature, and thus, the difference between the detected temperature (present temperature) and the reference temperature is very large ($T_B-T_0$). In this embodiment, through use of $T_A$ as the reference temperature, the difference between the detected temperature and the reference temperature is reduced ($T_B-T_A$). This suppresses the influence of variations in resistance $\rho_{B0}$ at $T_0$ (23° C.) and variations in TCR value (slope of the line segment J in FIG. 19). Meanwhile, the heat generation area A has a wide region, and thus, when this embodiment using $\rho_A$ is used, it is necessary to give consideration to the longitudinal temperature distribution of the heat generation area A. Therefore, with regard to the temperature detecting method according to the first embodiment, or the temperature detecting method according to the third embodiment, in view of the temperature distribution of the fixing device and the TCR characteristics of the heat generating resistors, the more suitable structure may be selected.

Further, the temperature detecting method described in this embodiment can be applied to the temperature control using the result of resistance measurement of the heat generation areas B of the second embodiment (FIG. 14 and FIG. 16). Further, in this embodiment, in FIG. 19, the temperature detecting method with regard to the PTC characteristics was described. Temperature detection of a heat generation area without an individual temperature detection element is possible, however, using the temperature characteristics of the resistance with regard to the NTC characteristics. Other than this, the structures of the embodiments described above can be applied in combination with each other to the greatest extent possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus comprising:

(A) a fixing unit configured to fix an image, formed on a recording material, to the recording material, the fixing unit including:

(a) a heater having:

(i) a first heat generation member; and (ii) a second heat generation member controllable independently of the first heat generation member and formed in a region different from a region in which the first heat generation member is formed in a direction orthogonal to a recording material conveyance direction; and (b) a temperature detection element configured to detect a temperature of the region in which the first heat generation member is formed of the heater;

(B) an energization control unit configured to control energization to the first heat generation member depending on the temperature detected by the temperature detection element, (C) a resistance detecting unit configured to detect a resistance of the second heat generation member; and (D) a temperature acquiring unit configured to acquire a temperature of the heater in the region in which the second heat generation member is formed based on the resistance detected by the resistance detecting unit, wherein the image, formed on the recording material, is fixed to the recording material with heat from the heater.

2. The image forming apparatus according to claim 1, wherein the temperature acquiring unit is configured to acquire the temperature of the heater in the region in which the second heat generation member is formed based on the resistance detected by the resistance detecting unit and a temperature coefficient of resistance of the second heat generation member.

3. The image forming apparatus according to claim 2, wherein the temperature coefficient of resistance of the second heat generation member is stored in a memory arranged in the image forming apparatus.

4. The image forming apparatus according to claim 1, wherein the resistance detecting unit is configured to detect the resistance of the second heat generation member through detection of a current passing through the second heat generation member and a voltage applied to the second heat generation member.

5. The image forming apparatus according to claim 1, wherein, when the temperature acquired by the temperature acquiring unit becomes greater than a predetermined high temperature threshold value in continuous image formation on a plurality of recording materials, the image forming apparatus executes any one of increasing conveyance intervals of the recording materials and reducing a conveyance speed of the recording materials.

6. The image forming apparatus according to claim 1, wherein when the temperature acquired by the temperature acquiring unit becomes greater than a predetermined high temperature threshold value, the image forming apparatus stops image formation.

7. The image forming apparatus according to claim 1, wherein the energization control unit is configured to control energization to the second heat generation member based on the temperature acquired by the temperature acquiring unit.

8. The image forming apparatus according to claim 1, further comprising (E) a second resistance detecting unit configured to acquire a resistance of the first heat generation member, wherein the temperature acquiring unit is configured to acquire the temperature of the region in which the second heat generation member is formed based on difference between the resistance of the first heat generation member detected by the second resistance detecting unit and the resistance of the second heat generation member detected by the resistance detecting unit, and based on the temperature of the region in which the first heat generation member is formed, which is detected by the temperature detection element.

9. The image forming apparatus according to claim 1, wherein the second heat generation member is formed on each of both sides of the first heat generation member in the direction orthogonal to the recording material conveyance direction.

10. The image forming apparatus according to claim 1, wherein each of the first heat generation member and the second heat generation member is energized via a conductor pair arranged at different locations in the recording material conveyance direction.

11. The image forming apparatus according to claim 1, wherein the heater comprises a ceramic substrate, and the first heat generation member and the second heat generation member are formed on the substrate.

12. The image forming apparatus according to claim 11, wherein the heater further includes:

(iii) a first electrode held in contact with a wiring for energizing the first heat generation member; and (iv) a second electrode held in contact with wiring for energizing the second heat generation member, wherein the first electrode is formed in the region in which the first heat generation member is formed, and the second electrode is formed in the region in which the second heat generation member is formed in the direction orthogonal to the recording material conveyance direction.

13. The image forming apparatus according to claim 11, wherein the fixing unit further includes (c) a holder configured to hold the heater, the holder having a hole through which a wire passes.

14. The image forming apparatus according to claim 13, wherein the fixing unit further includes (d) a tubular film, the heater being held in contact with an inner surface of the tubular film.

* * * * *